US012063988B2

(12) United States Patent
Yanagisawa et al.

(10) Patent No.: US 12,063,988 B2
(45) Date of Patent: Aug. 20, 2024

(54) WEARABLE AIRBAG DEVICE

(71) Applicant: TOYODA GOSEI CO., LTD., Kiyosu (JP)

(72) Inventors: Toshihito Yanagisawa, Kiyosu (JP); Wataru Miura, Kiyosu (JP); Yusuke Kawamura, Kiyosu (JP); Kunihiro Aikawa, Kiyosu (JP)

(73) Assignee: TOYODA GOSEI CO., LTD., Aichi-pref. (JP)

( * ) Notice: Subject to any disclaimer, the term of this patent is extended or adjusted under 35 U.S.C. 154(b) by 279 days.

(21) Appl. No.: 17/529,523

(22) Filed: Nov. 18, 2021

(65) Prior Publication Data

US 2022/0192285 A1 Jun. 23, 2022

(30) Foreign Application Priority Data

Dec. 18, 2020 (JP) ..... 2020-210378
Dec. 25, 2020 (JP) ..... 2020-216861

(51) Int. Cl.
*A41D 13/015* (2006.01)
*A41D 13/05* (2006.01)

(52) U.S. Cl.
CPC ..... *A41D 13/0155* (2013.01); *A41D 13/0506* (2013.01)

(58) Field of Classification Search
CPC ..... A41D 13/015; A41D 13/018; A41D 13/0506; A41D 13/0155
See application file for complete search history.

(56) References Cited

U.S. PATENT DOCUMENTS 5,500,952 A * 3/1996 Keyes ..... A41D 13/018 2/908
6,920,647 B2 * 7/2005 Ulert ..... A41D 13/018 2/DIG. 3

(Continued)

FOREIGN PATENT DOCUMENTS

CN 110037367 A 7/2019
JP WO2010/090317 A1 8/2010

(Continued)

OTHER PUBLICATIONS

Office Action dated Sep. 25, 2023 issued in corresponding Japanese Patent Application No. 2020-210378 (and English machine translation).

(Continued)

*Primary Examiner* — F Griffin Hall
(74) *Attorney, Agent, or Firm* — Posz Law Group, PLC

(57) ABSTRACT

A wearable airbag device for protecting the hip of a wearer includes an airbag that is formed of a sheet material having flexibility and is adapted to be put on a circumference of the pelvis of the wearer. The airbag is inflatable with an inflation gas. The airbag includes: a mounting portion that is adapted to be disposed at a region to be wrapped around the pelvis at airbag deployment; two protecting portions each of which is configured to extend downward from the mounting portion and cover an outer side of a targeted body part of the wearer at airbag deployment, the targeted body part being left and right trochanters of femurs; and a means for suppressing each of the protecting portions from expanding and floating away from the targeted body part at the lower end at deployment of the protecting portion.

6 Claims, 30 Drawing Sheets

(56) References Cited

U.S. PATENT DOCUMENTS

| | | | | |
|---|---|---|---|---|
| 10,149,638 | B2 * | 12/2018 | Buckman | G01C 19/00 |
| 2004/0003455 | A1 * | 1/2004 | Davidson | A41D 13/018 2/455 |
| 2012/0131718 | A1 | 5/2012 | Uchida et al. | |
| 2014/0123374 | A1 * | 5/2014 | Gelston | A41D 13/018 2/455 |
| 2014/0352042 | A1 * | 12/2014 | Celi | A41D 13/0155 2/455 |
| 2015/0101112 | A1 * | 4/2015 | Balbien | A41D 13/018 2/455 |
| 2017/0224031 | A1 | 8/2017 | Raanan | |
| 2021/0352975 | A1 * | 11/2021 | Song | A63B 71/081 |

FOREIGN PATENT DOCUMENTS

| | | | | |
|---|---|---|---|---|
| JP | 2010-264965 | A | | 11/2010 |
| JP | 2014-514462 | A | | 6/2014 |
| JP | 2019163574 | A | * | 9/2016 |
| JP | 2019-163574 | A | | 9/2019 |
| KR | 10-2050872 | B1 | | 12/2019 |
| WO | 2019/207474 | A1 | | 10/2019 |

OTHER PUBLICATIONS

Office Action dated Sep. 25, 2023 issued in corresponding Japanese Patent Application No. 2020-216861 (and English machine translation).

* cited by examiner

WEARABLE AIRBAG DEVICE

CROSS REFERENCE TO RELATED APPLICATIONS

The present application claims priority from Japanese Patent Application No. 2020-210378 of Yanagisawa et al., filed on Dec. 18, 2020, and Japanese Patent Application No. 2020-216861 of Yanagisawa et al., filed on Dec. 25, 2020, the entire disclosures of which are incorporated herein by reference.

BACKGROUND

1. Technical Field

The present disclosure relates to a wearable airbag device for protecting the hip of a wearer.

2. Description of Related Art

WO 2019/207474 A1 discloses a wearable airbag device for protecting the hip of a wearer such as an elderly person in the event of a fall or the like. This airbag device is designed to be wrapped around the waist of the wearer so as to inflate and deploy an airbag downward for protecting their hip when activated.

Since the above airbag device is configured to deploy the airbag downward from a state wrapped around the waist, the airbag as deployed comes to flare out and float away from the hip at the bottom. In other words, in the above airbag device, the airbag is wrapped around the pelvis which is narrower than the hip (i.e. location of trochanters) and deployed downward therefrom to cover the hip which is thicker than the pelvis. As a consequence, the airbag as deployed comes to float away from the hip at the bottom. There is a fear that such an airbag fails to cover the hip quickly and adequately in the event of a fall or the like.

SUMMARY

The first embodiment in the present disclosure relates to a wearable airbag device adapted to be worn by a wearer for protecting the hip of the wearer. The airbag device includes an airbag that is formed of a sheet material having flexibility and is adapted to be put on a circumference of the pelvis of the wearer, the airbag being configured to be inflated with an inflation gas. The airbag includes: a mounting portion that is adapted to be disposed at a region to be wrapped around the pelvis at airbag deployment; two protecting portions each of which is configured to extend downward from the mounting portion and cover an outer side of a targeted body part of the wearer at airbag deployment, the targeted body part being left and right trochanters of femurs; and a means for suppressing each of the protecting portions from expanding and floating away from the targeted body part at the lower end at deployment of the protecting portion.

The second embodiment of the disclosure relates to a wearable airbag device adapted to be worn by a wearer for protecting the hip of the wearer. The airbag device includes an airbag that is adapted to be put on a circumference of the pelvis of the wearer, the airbag being configured to be inflated with an inflation gas. The airbag includes: at least one protecting portion that is configured to cover an outer side of a targeted body part of the wearer at airbag deployment, the targeted body part being the left or right trochanter of femur and surroundings, the at least one protecting portion each including an inner surface which faces toward the wearer when worn and an upper end portion; and a protruding inflatable portion that is disposed in the inner surface of each of the at least one protecting portion, the protruding inflatable portion being configured to protrude towards the trochanter at airbag deployment such that a leading end of the protruding inflatable portion is located at a farther inward position than the upper end portion of the protecting portion.

BRIEF DESCRIPTION OF DRAWINGS

FIG. 6 is a schematic horizontal sectional view of a left portion of the airbag.

FIG. 28 is a schematic horizontal sectional view of a left portion of the airbag.

DETAILED DESCRIPTION

Exemplary embodiments of the present disclosure are described below with reference to the accompanying drawings. However, the invention is not limited to the embodiments disclosed herein. All modifications within the appended claims and equivalents relative thereto are intended to be encompassed in the scope of the claims.

Figure 1:
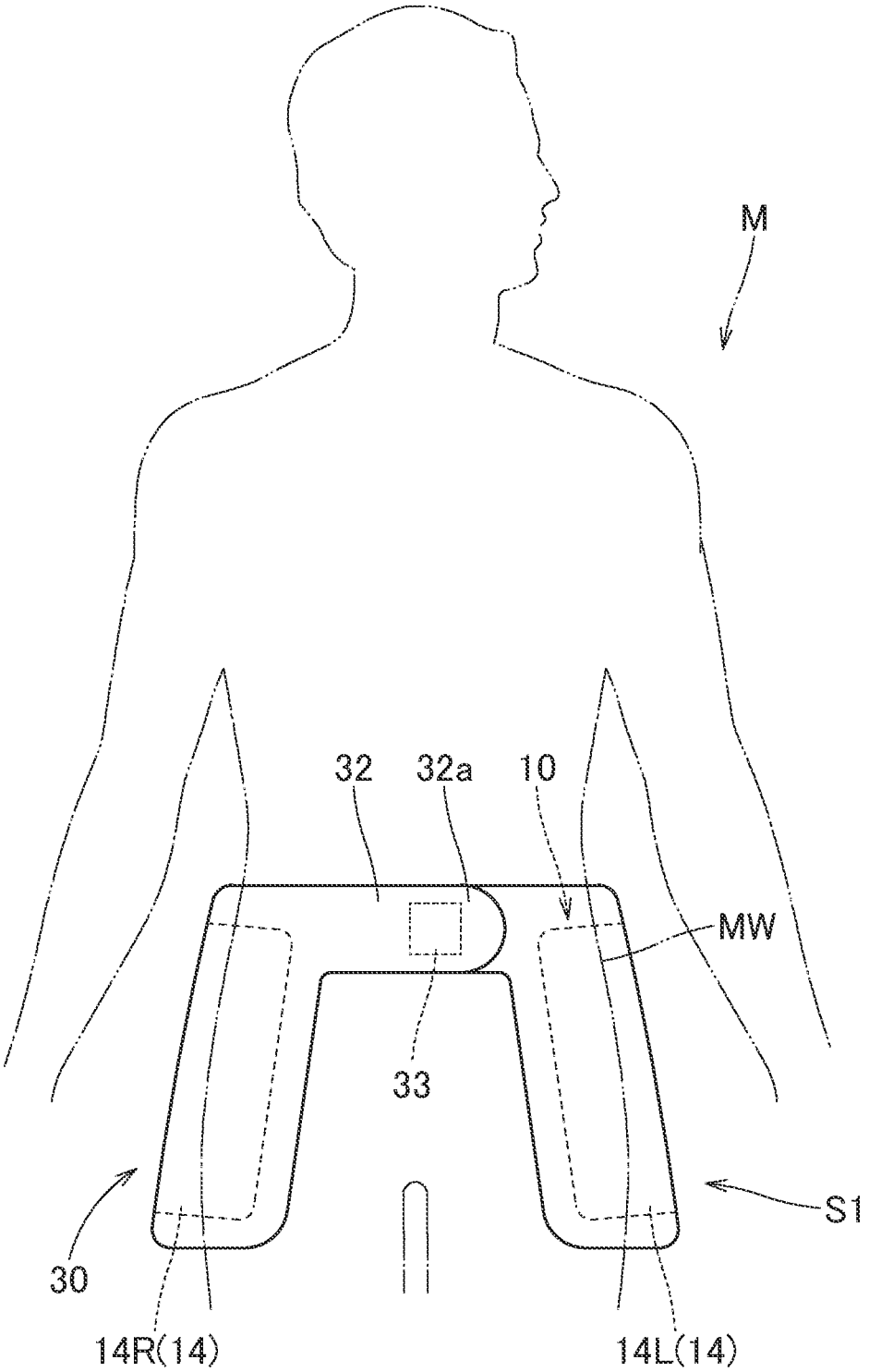
FIG. 1 schematically depicts a wearable airbag device in accordance with the first embodiment as worn by a wearer.

A wearable airbag device S1 in accordance with the first embodiment is configured to be wrapped around the hip MW (more particularly, around the pelvis MP) of a wearer M, as can be seen in FIG. 1. Unless otherwise specified, up-down, front-rear, and left-right directions in this embodiment are intended to refer to up-down, front-rear, and left-right directions as viewed from the wearer M wearing the airbag device S1.

Figure 2:
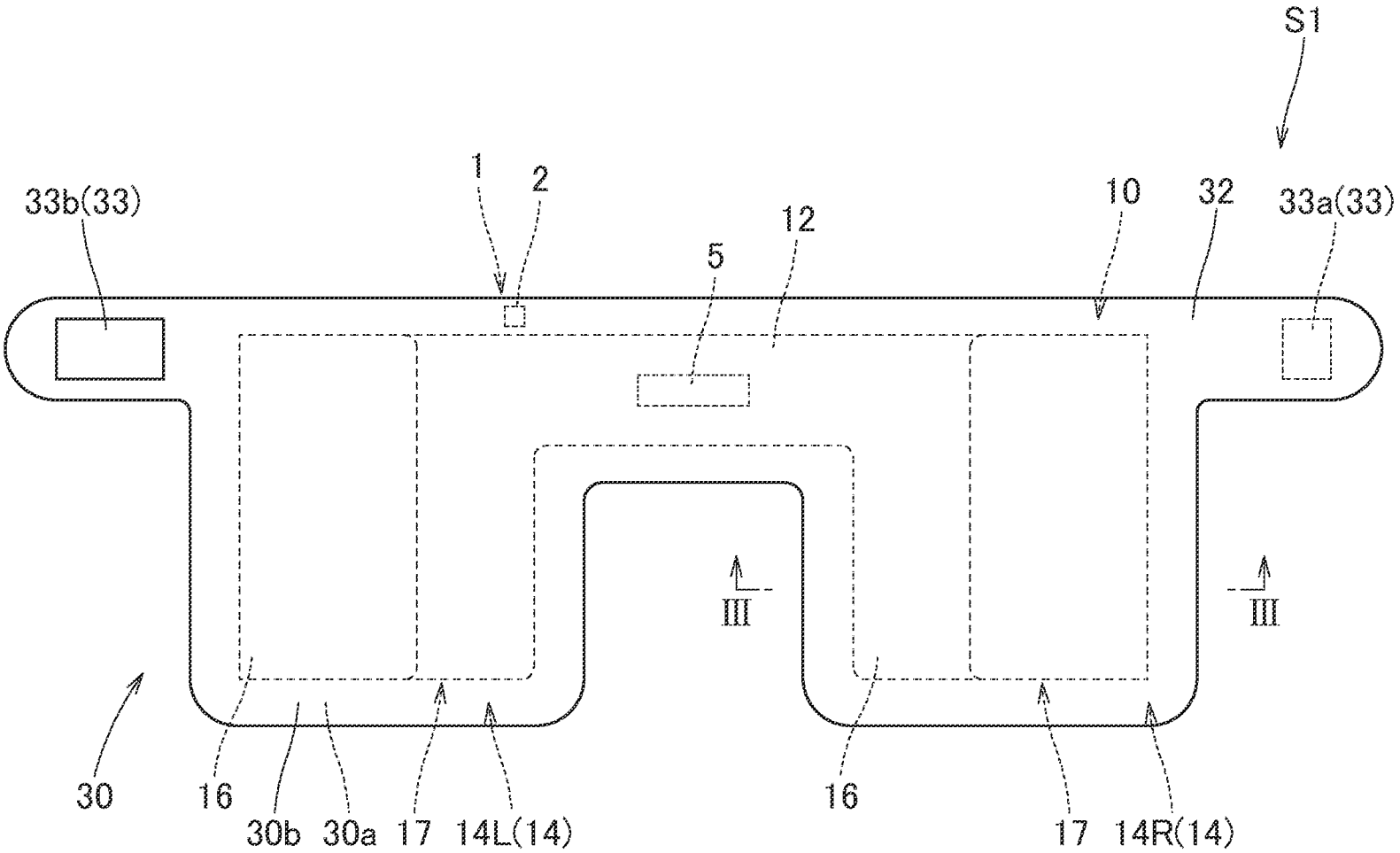
FIG. 2 is a plan view of the wearable airbag device of the first embodiment as laid flat.
Figure 3:
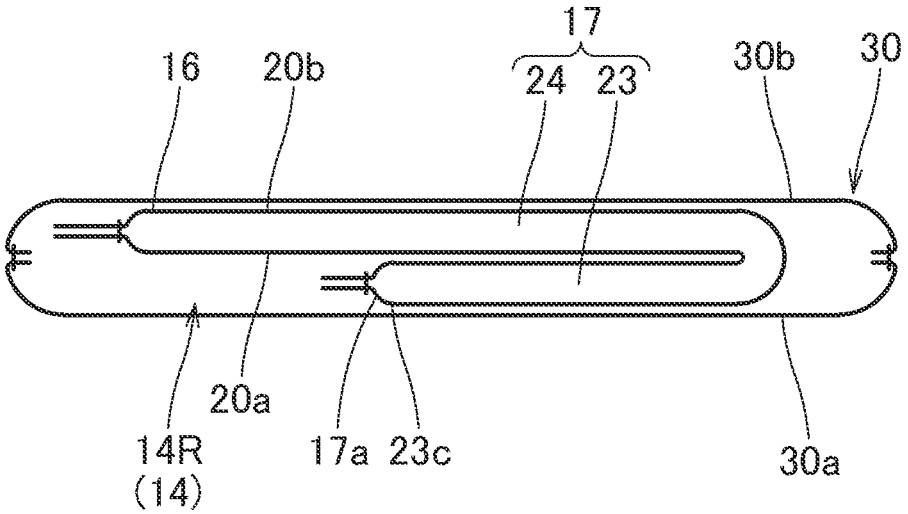
FIG. 3 is a schematic sectional view taken along line III-Ill of FIG. 2.

As can be seen in FIGS. 1 to 3, the wearable airbag device S1 includes an airbag 10, a gas generator 5 for feeding the airbag 10 with an inflation gas, an operation control device 1 that includes a sensor part 2 for detecting a fall of the wearer M and is configured to actuate the gas generator 5, and an outer cover 30 that covers an outer circumference of the airbag 10. In the wearable airbag device S1 in accordance with the first embodiment, the airbag 10 is disposed inside the outer cover 30 in a developed or unfolded state, as can be seen in FIGS. 2 and 3.

The operation control device 1 includes a sensor part 2 that includes an angular velocity sensor capable of sensing angular velocities around three axes in up and down, front and rear, and left and right directions, and an acceleration sensor capable of sensing accelerations in the three-axis directions. The operation control device 1 is configured to actuate the gas generator 5 in response to a signal fed from the sensor part 2 as has sensed a falling behavior different from a normal behavior of the wearer M. More particularly, the operation control device 1 includes a determining means that is configured to determine based on various thresholds, and is configured to actuate the gas generator 5 upon sensing a fall of the wearer M based on the determination by the determining means. The operation control device 1 further includes a power source composed of a not-shown battery or the like for operation of the sensor part 2 and for emission of an actuating signal to the gas generator 5.

The airbag 10 is made of a sheet material having flexibility. The airbag 10 of this specific embodiment is made of a fabric woven with polyester yarns, polyamide yarns or the like. The airbag 10 is adapted to be wrapped around the pelvis MP of the wearer M through the use of a later-described belt 32 of the outer cover 30. In this embodiment, the airbag 10 is configured to cover left and right sides of the hip MW of the wearer M when worn, as can be seen in FIG. 1. The airbag 10 includes a mounting portion 12 that is configured to be disposed at a region to be wrapped around the pelvis MP at airbag deployment, and two protecting portions 14 (14L, 14R) each of which is configured to extend downward from the mounting portion 12 at airbag deployment. The mounting portion 12 of this embodiment is designed to provide gas communication between the protecting portions 14L, 14R at upper ends of the protecting portions 14L, 14R. The airbag 10 is designed to be bilaterally symmetrical in shape as laid flat.

The mounting portion 12 is designed to be inflated into a rod shape elongated substantially along a left and right direction. As can be seen in FIG. 2, the mounting portion 12 is disposed at a location continuing from the belt 32 of the outer cover 30. The mounting portion 12 is configured to be deployed at the position continuing from the belt 32 and at the rear of the pelvis MP of the wearer M at airbag deployment. That is, the mounting portion 12 is configured to be deployed at a region to be wrapped around the pelvis MP, at airbag deployment. In this specific embodiment, the gas generator 5 is connected to the mounting portion 12 for feeding the airbag 10 with an inflation gas, as can be seen in FIG. 2. That is, the mounting portion 12 also serves as a gas feeding path to deliver the inflation gas to each of the protecting portions 14. Although not depicted in detail, the gas generator 5 is disposed in a vicinity of the center in the length direction of the mounting portion 12. The gas generator 5 contains a compressed gas in a sealed state, and is designed to discharge a cold gas into the airbag 10 when actuated and unsealed. The gas generator 5 is electrically connected to the operation control device 1 and configured to be actuated when fed with an actuating signal from the operation control device 1 as has sensed a fall of the wearer M.

Figure 4:
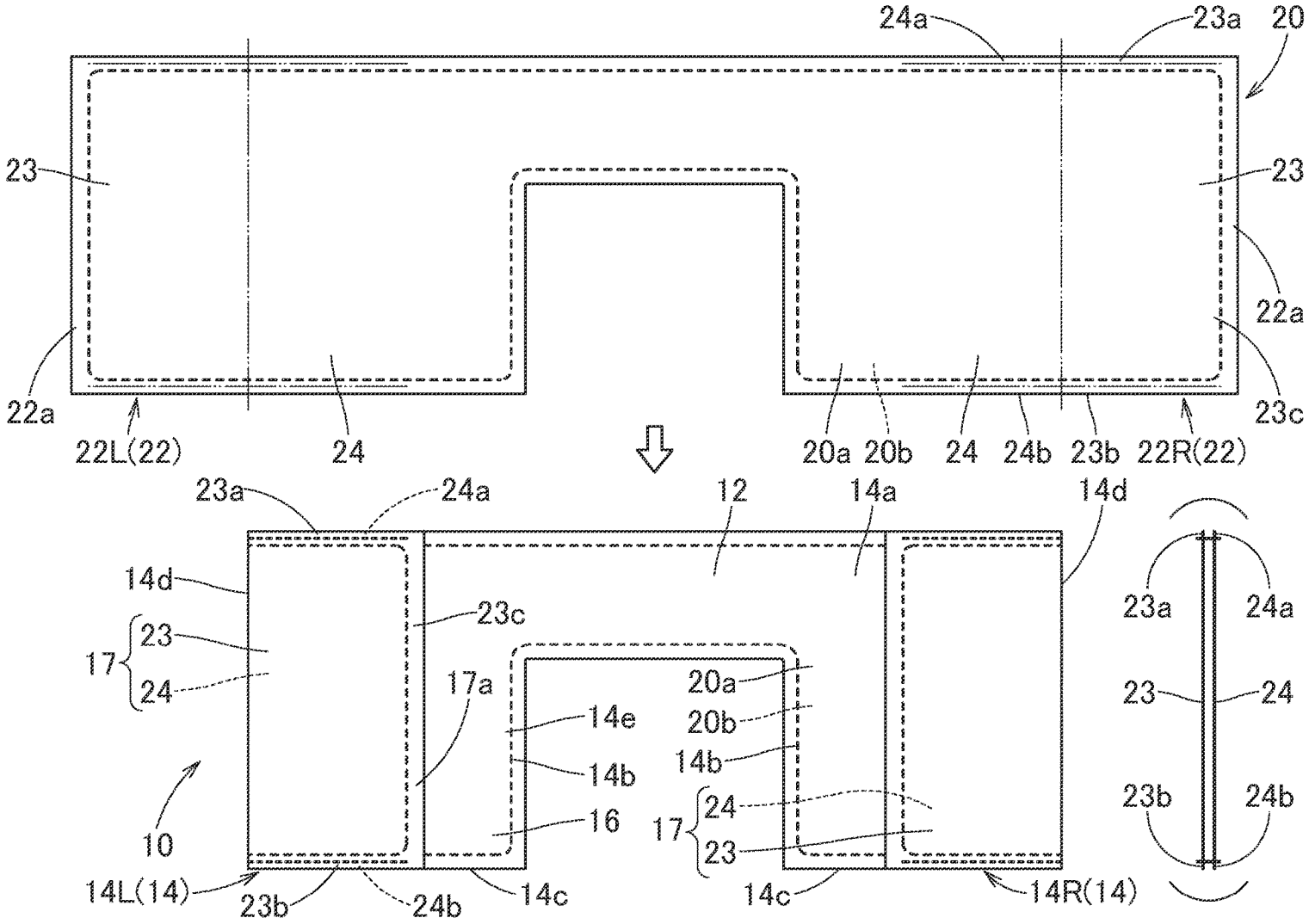
FIG. 4 depicts an airbag for use in the airbag device of the first embodiment as laid flat and an airbag component for forming the airbag as laid flat, by plan.
Figure 6:
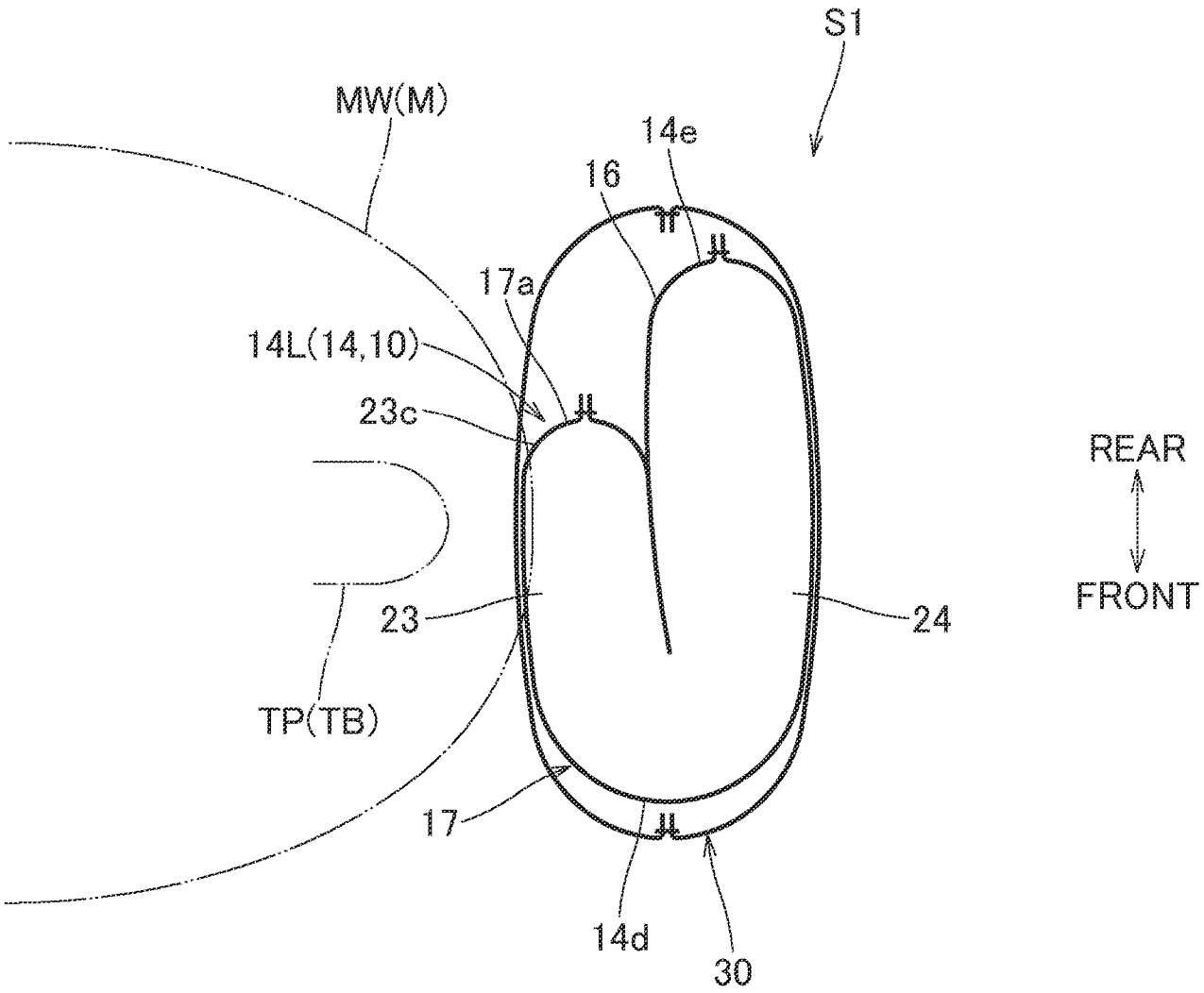
FIG. 6 is a schematic partial horizontal sectional view of the airbag as deployed taken along a front and rear direction in the wearable airbag device of the first embodiment. More particularly.
Figure 7:
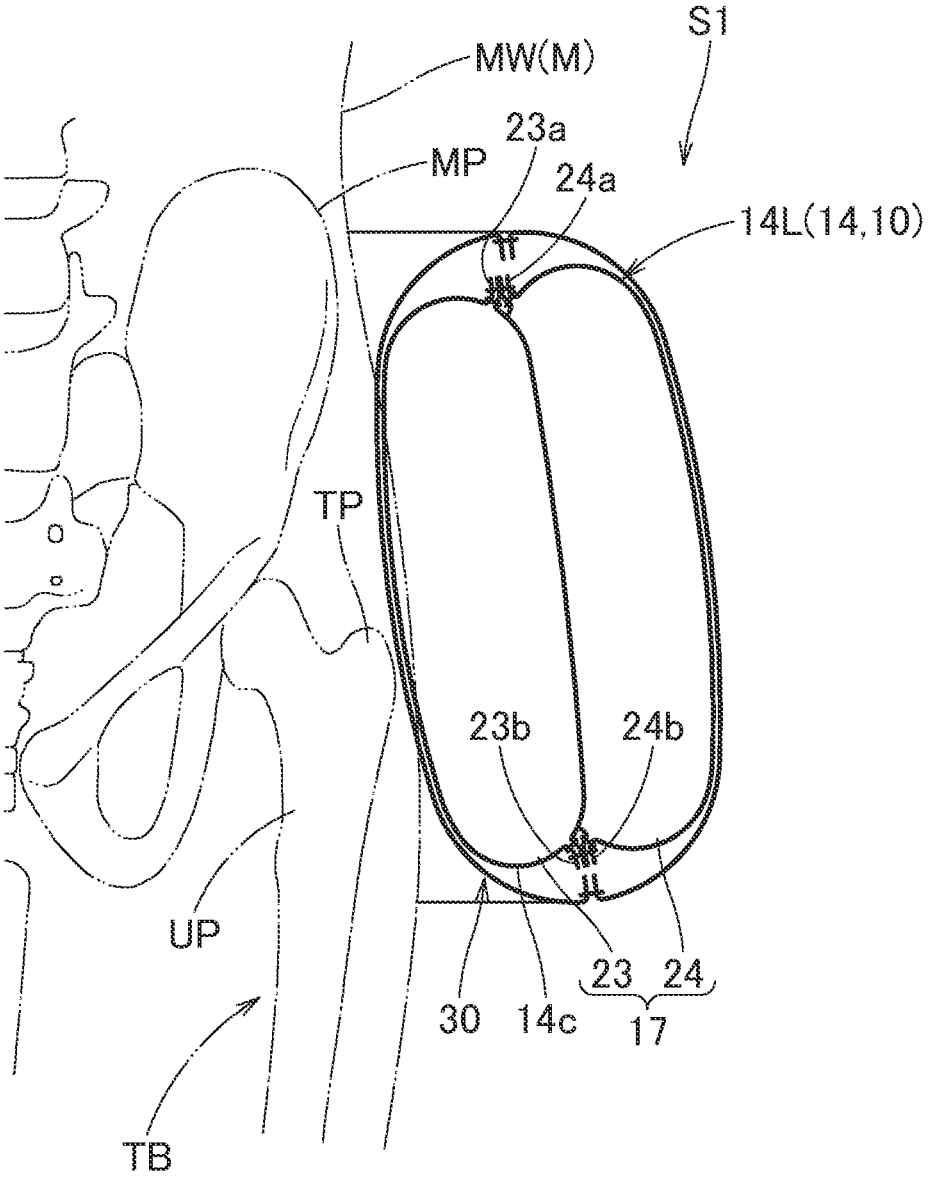
FIG. 7 is a schematic vertical sectional view of the airbag as deployed in a worn state, in the wearable airbag device of the first embodiment.

The protecting portions 14 (14L, 14R) are designed to extend downward and outwardly in the left and right direction from the mounting portion 12, in the airbag 10 as laid flat. In order to cover the trochanter (greater trochanter) TP of femur as a targeted body part and surroundings amply, including regions disposed above and beneath the trochanter TP, each of the protecting portions 14 as laid flat has a substantially rectangular outer shape. As can be seen in FIG. 4, each of the protecting portions 14 includes an upper region 14*a* that extends outwardly in the left and right direction from the mounting portion 12, and a lower region 14*b* that extends downward from the upper region 14*a*. More particularly, each of the protecting portions 14 is designed to cover a side (an outer side) of the pelvis MP to the subtrochanteric region UP when worn, as shown in FIG. 7. As can be seen in FIG. 4, each of the protecting portions 14 includes, in an outer edge region as laid flat (in an outer edge region in the left and right direction as laid flat, and in the front edge 14*d* as worn), a double-wall portion 17 in which an inflatable region are doubled. The double-wall portion 17 as fully inflated has an approximately double thickness as that of a general region 16 of the protecting portion 14 disposed toward the rear edge 14*e* as worn, since the double-wall portion 17 is composed of the doubled inflatable regions (a later-described foldable portion 23 and receiving portion 24), as can be seen in FIG. 6. The double-wall portion 17 is formed in an entire region in an up and down direction of each of the protecting portions 14. The double-wall portion 17 constitutes a means for suppressing the protecting portion from expanding or flaring out at the lower end (namely, an expansion-suppressing means). In this specific embodiment, each of the protecting portions 14 is designed such that the double-wall portion 17 occupies more than a half area of the protecting portion 14 in the front and rear direction from the front edge 14*d* at airbag deployment. More particularly, each of the protecting portions 14 is designed such that an inward end portion 17*a* of the double-wall portion 17 (i.e. an end 23*c* of the foldable portion 23) is deployed at a left/right side of the trochanter TP, as can be seen in FIG. 6.

In this embodiment, as shown in FIG. 4, the airbag 10 is composed of an airbag component 20. The airbag component 20 includes an inner wall 20*a* that is configured to be disposed towards the wearer M (i.e. in the inner side) when worn, and an outer wall 20*b* that is configured to be disposed on the outer side when worn, and formed by being jointed together by circumferential edges of the inner wall 20*a* and outer wall 20*b*. The inner wall 20*a* and outer wall 20*b* are substantially identical in outer shape. The airbag component 20 includes two portions 22 for forming the protecting portions 14 (namely, protecting-portion-forming portions). Each of the protecting-portion-forming portions 22 is formed substantially into a rectangle that is greater in width in the left and right direction than the protecting portion 14 of the airbag 10 by the width of the double-wall portion 17. Each of the protecting-portion-forming portions 22 as laid flat includes a foldable portion 23 that is disposed toward the outer edge in the left and right direction and a receiving portion 24 that adjoins the foldable portion 23 at an inner side in the left and right direction. Each of the double-wall portion 17 is formed by folding the foldable portion 23 over an inner side (the inner wall 20*a*) of the receiving portion 24 and joining the foldable portion 23 and receiving portion 24 together at upper ends 23*a*, 24*a* and lower ends 23*b*, 24*b*, by way of example by sewing with sewing threads, as can be seen in FIGS. 3 and 4.

The outer cover 30 is made of a flexible woven fabric having better touch than the base cloths of the airbag 10. The outer cover 30 covers an entirety of the outer circumference of the airbag 10. The outer cover 30 includes an inner wall 30*a* that is disposed in the inner side (i.e. towards the wearer M) when worn, and an outer wall 30*b* that is disposed on the outer side when worn, and is formed into a bag by being jointed (or sewn) together by circumferential edges of the inner wall 30*a* and outer wall 30*b*. An outer shape of the outer cover 30 as laid flat is greater than the airbag 10 as laid flat so as to allow the airbag 10 to inflate smoothly inside the outer cover 30, as can be seen in FIG. 2. The outer cover 30 includes a pair of belts 32 that protrude outwardly toward the left and right in a vicinity of the upper edge. The belts 32 include a fastening means at the leading ends 32*a*. The fastening means in this embodiment is composed of a hook-and-loop fastener 33 including hooks 33*a* and loops 33*b* engageable with one another so as to enable the wearer M to wear the airbag device S1 easily and to wear according to the size of the waist.

Figure 5:
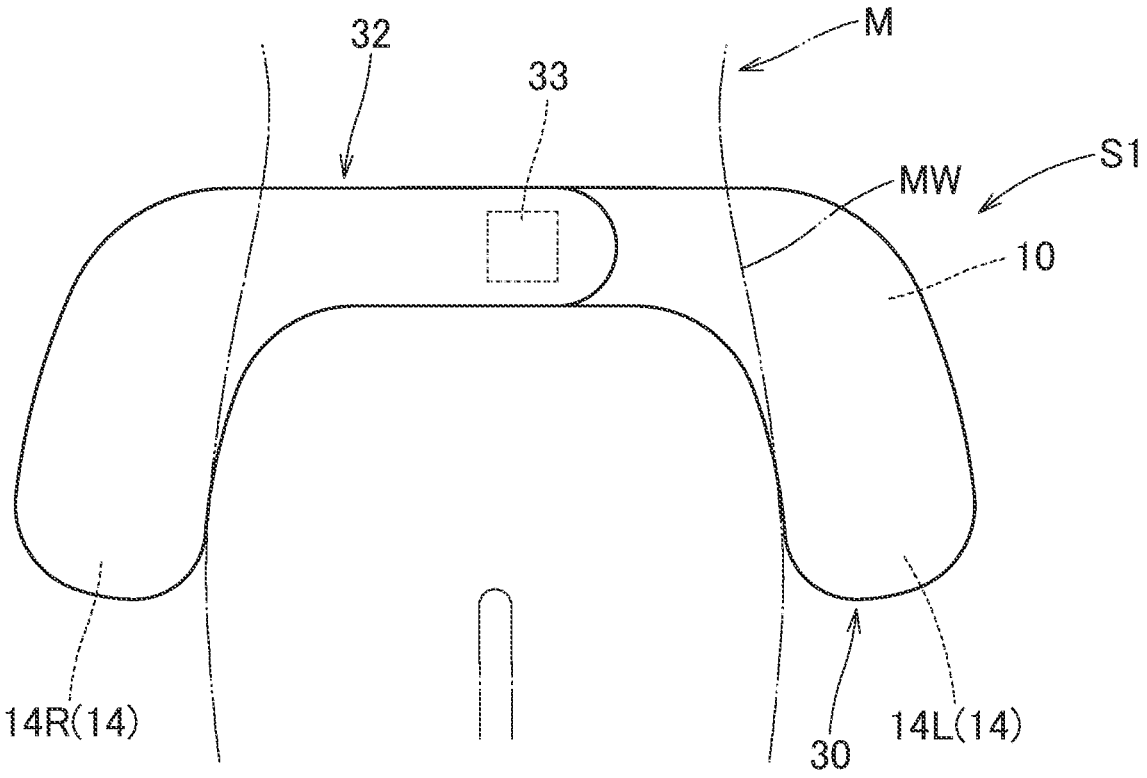
FIG. 5 schematically depicts the wearable airbag device of the first embodiment as worn by the wearer at airbag deployment.

The wearable airbag device S1 in accordance with the first embodiment is put on around the hip MW (pelvis MP) of the wearer M in a wrapping manner by fastening the leading ends 32*a* of the belts 32 of the outer cover 30 together with the use of the hook-and-loop fastener 33 (as the fastening means), as can be seen in FIG. 1. If the sensor part 2 detects a falling behavior of the wearer M as wearing the airbag device S1, the operation control device 1 sends an actuating signal to the gas generator 5, the gas generator 5 feeds an inflation gas to the airbag 10, so that the airbag 10 is deployed as shown in FIGS. 5 to 7.

In the wearable airbag device S1 of the first embodiment, the protecting portions 14 (14L, 14R) for covering the targeted body parts (i.e. the trochanters TP) are configured to extend downward from the mounting portion 12 as put on around the pelvis MP. However, the double-wall portion 17 as the expansion-suppressing means suppresses each of the protecting portions 14L, 14R from expanding and floating away from the targeted body part at the lower end 14*c*. Accordingly, each of the protecting portions 14L, 14R will be deployed in proximity to the targeted body part (i.e. the trochanter TP) and cover the outer side of the targeted body part (i.e. the trochanter TP) quickly and adequately, as can be seen in FIG. 7.

Therefore, the wearable airbag device S1 in accordance with the first embodiment is able to protect the hip MW of the wearer M in a steady fashion.

More particularly, in the wearable airbag device S1 of the first embodiment, each of the protecting portions 14 of the airbag 10 includes, in the front edge 14*d* as worn, the double-wall portion 17 in which the foldable portion 23 and the receiving portion 24 in the protecting-portion-forming portions 22 of the airbag component 20 are doubled, as shown in FIG. 6. The double-wall portion 17 constitutes the expansion-suppressing means. That is, in the wearable airbag device S1 of the first embodiment, each of the protecting portions 14 is designed to be inflated partially thick due to the double-wall portion 17 composed of the foldable portion 23 and receiving portion 24, and the foldable portion 23 and receiving portion 24, each of which is inflatable into a board shape, are joined together at upper ends and lower ends. This configuration will enhance rigidity of each of the protecting portions 14 as inflated and prevent the protecting portion 14 as inflated from expanding at the lower end 14*c* adequately. In the airbag 10, especially, the double-wall portion 17 is designed so that the inward end portion 17*a* (i.e. the end 23*c* of the foldable portion 23) is deployed at a left or right side of the trochanter TP. In other words, the protecting portion 14 is designed to cover the left or right side of the trochanter TP (i.e. the targeted body part) with the double-wall portion 17 which is inflated thicker than the general portion 16 disposed in the rear side. Therefore, the airbag 10 is able to protect the trochanters TP adequately. Although the double-wall portion 17 of the airbag 10 of the illustrated embodiment is formed by folding the foldable portion 23 over the inner side of the receiving portion 24, it may also be formed by folding the foldable portion over the outer side of the receiving portion. However, it is more preferable to fold the foldable portion over the inner side of the receiving portion in order to maintain the doubled state of the foldable portion and receiving portion securely at fall of the wearer.

Figure 8:
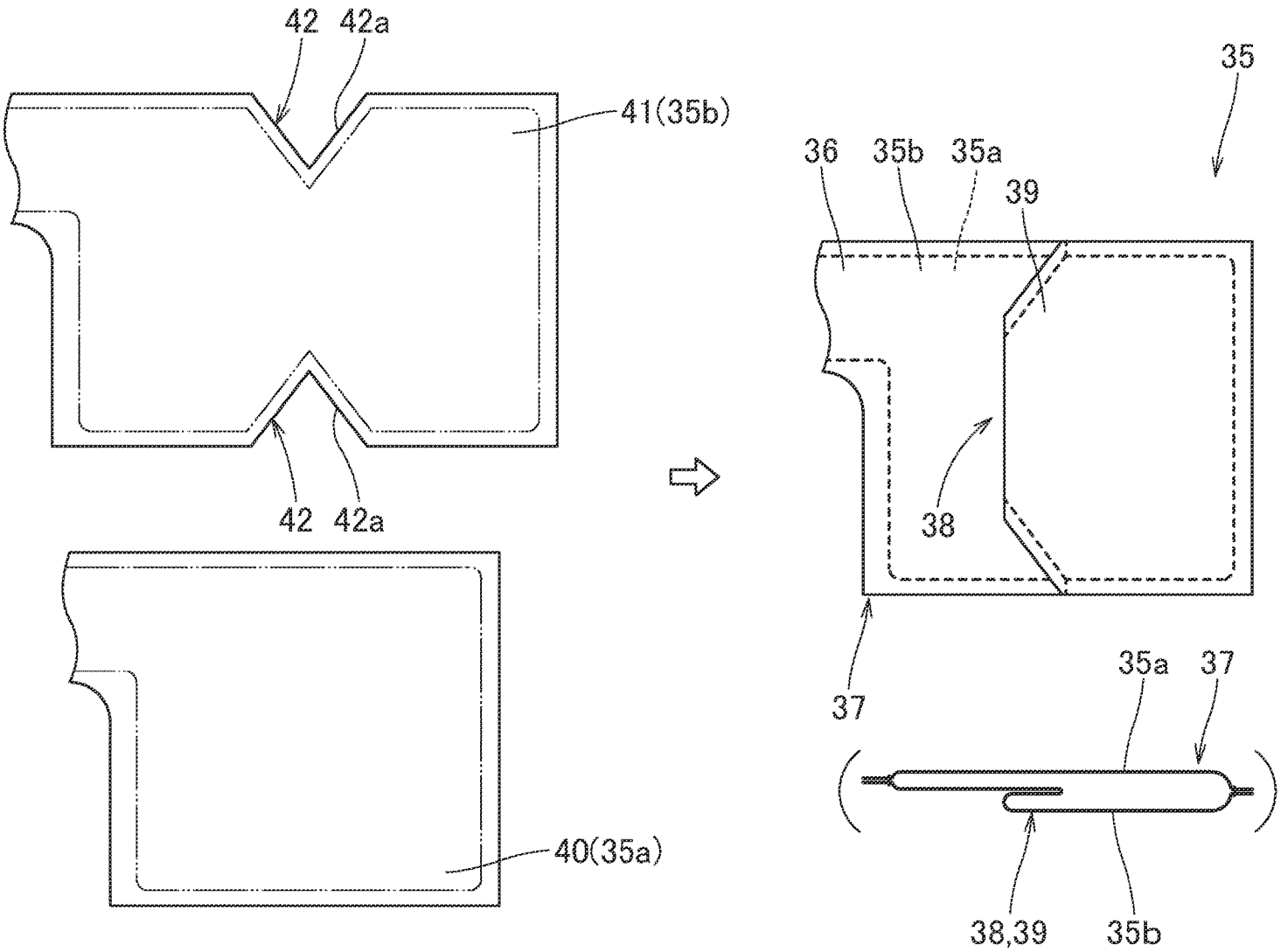
FIG. 8 depicts a modification of the airbag and base members thereof in partial enlarged plan.
Figure 9:
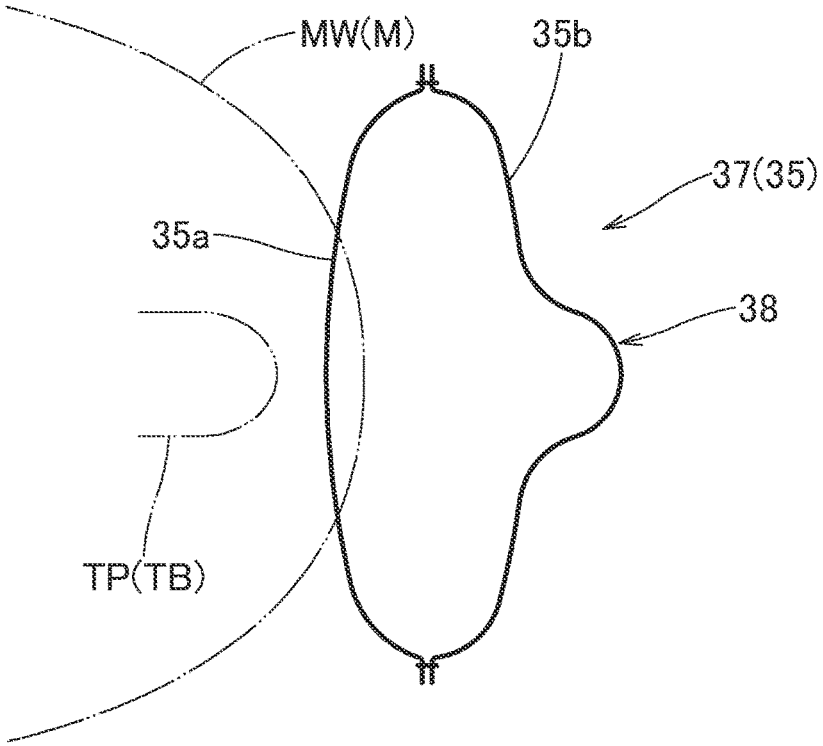
FIG. 9 is a schematic horizontal sectional view of the airbag of FIG. 8 as deployed in a worn state.
Figure 10:
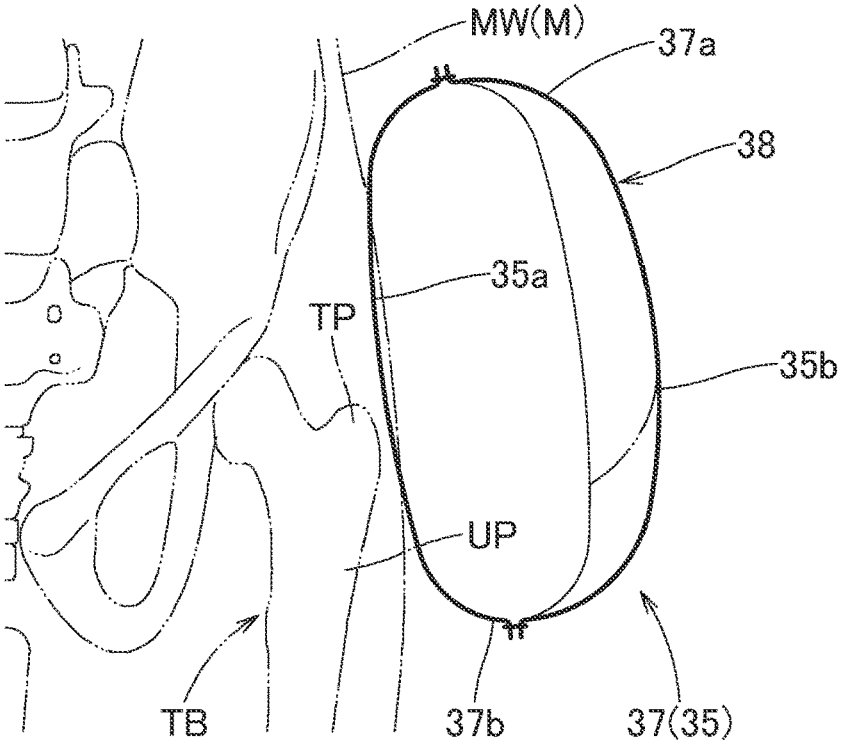
FIG. 10 is a schematic vertical sectional view of the airbag of FIG. 8 as deployed in the worn state.

The airbag may alternatively be configured like an airbag 35 depicted in FIGS. 8 to 11. Similarly to the airbag 10 described above, the airbag 35 includes a mounting portion 36 that is configured to be disposed at a region to be wrapped around the pelvis MP at airbag deployment, and two protecting portions 37 each of which is configured to extend downward from the mounting portion 36 at airbag deployment. The protecting portions 37 are designed to extend downward and outwardly in the left and right direction from the mounting portion 36, in the airbag 35 as laid flat. In order to cover the trochanter TP of femur (i.e. targeted body part) and surroundings amply including regions disposed above and beneath the trochanter TP, each of the protecting portions 37 as laid flat has a substantially rectangular outer shape. More particularly, also in the airbag 35, each of the protecting portions 37 is designed to cover an outer side of the pelvis MP to the subtrochanteric region UP when worn, as shown in FIG. 10. The airbag 35 includes an inner wall 35*a* that is configured to be disposed towards the wearer M when worn, and an outer wall 35*b* that is configured to face away from the wearer M when worn. The airbag 35 includes, in the outer wall 35*b* of each of the protecting portions 37, a protruding region 38 that is configured to protrude partially outwardly at airbag deployment. The protruding region 38 is disposed continuously substantially along an up and down direction in the outer wall 35*b* as worn. The protruding region 38 constitutes the expansion-suppressing means. The protruding region 38 is disposed at least in a region of the outer wall 35*b* for covering an outer side of a body part above the trochanter TP, in each of the protecting portions 37. In this specific embodiment, the protruding region 38 is disposed in a substantially entire area in the up and down direction of each of the protecting portions 37. Even more particularly, the protruding region 38 is disposed substantially at the center in the front and rear direction of each of the protecting portions 37, and at a position to be deployed at a left/right side of the trochanter TP, as can be seen in FIG. 9. The protruding region 38 is formed by lengthening a film length in the front and rear direction of the outer wall 35*b* compared with that of the inner wall 35*a* in order to form a tuck 39 in the outer wall 35*b*. More specifically, as shown in FIG. 8, an outer-wall member 41 for forming the outer wall 35*b* is provided with one each substantially V-shaped cut-out portion 42 in the upper edge and lower edge, and circumferential edges 42*a* of each of the cut-out portions 42 are joined together to form the tuck 39, thus forming the protruding region 38. The outer-wall member 41 has a greater width in the front and rear direction than an inner-wall member 40 for forming the inner wall 35*a* by the width in the front and rear direction of the cut-out portion 42 so that the outer-wall member 41 with the circumferential edges 42*a* of the cut-out portions 42 joined together is substantially identical in outer shape to the inner-wall member 40. Each of the protecting portions 37 of the airbag 35 is formed by joining together outer circumferential edges of the inner-wall member 40 and the outer-wall member 41 with the circumferential edges 42*a* of the cut-out portions 42 joined together.

Figure 11:
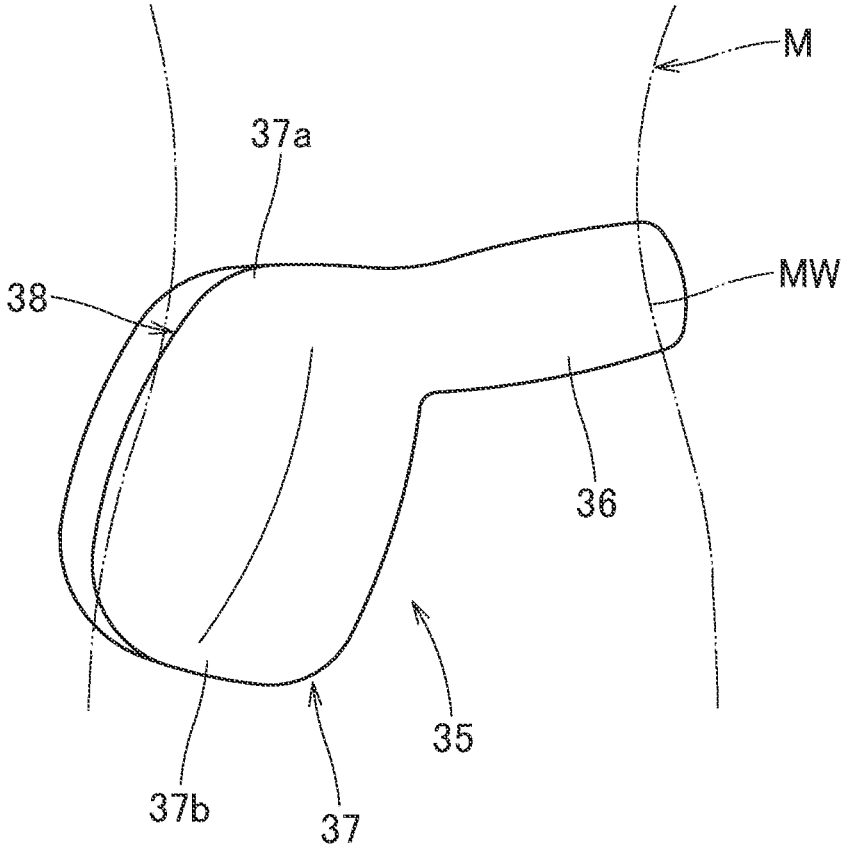
FIG. 11 is a schematic perspective view of the airbag of FIG. 8 as deployed in the worn state.

When the airbag 35 configured as described above is deployed, the protruding region 38 protrudes partially outwardly from the outer wall 35*b* of each of the protecting portions 37 and functions like a reinforcing rib extending in the up and down direction, as can be seen in FIG. 11. The protruding region 38 enhances rigidity of the protecting portion 37 and suppresses the protecting portion 37 as deployed from expanding at the lower end 37*b* adequately. More specifically, the airbag 35 comes to include, in each of the protecting portions 37, a protruding rib (i.e. the protruding region 38) that extends from the upper end 37*a* to the lower end 37*b*. The protruding rib (i.e. the protruding region 38) prevents the lower end 37*b* region of the protecting portion 37 from bending outwardly, thus prevents the protecting portion 37 from expanding at the lower end 37*b* at deployment. Accordingly, the airbag 35 is able to cover an outer side of the targeted body part (i.e. the trochanter TP) with the protecting portion 37 adequately, as can be seen in FIG. 10. Moreover, also in the airbag 35, the protruding region 38 is disposed at a position to be deployed at an outer side in the left and right direction of the trochanter TP, so that the airbag 35 is able to cover the outer side in the left and right direction of the trochanter TP (i.e. the targeted body part) with the protruding region 38 which is inflated thick, as shown in FIGS. 9 and 10. Therefore, the airbag 35 is able to protect the trochanters TP adequately. The outer cover is omitted in FIGS. 9 to 11.

Figure 12:
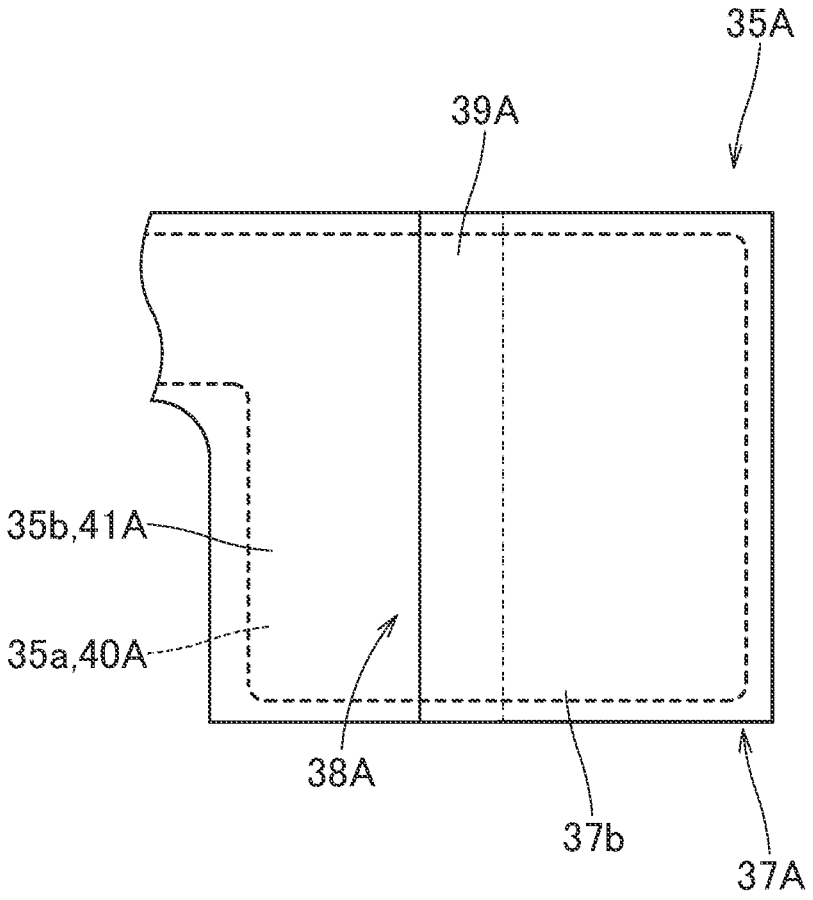
FIG. 12 is a partial enlarged plan view of another modification of the airbag.
Figure 12:
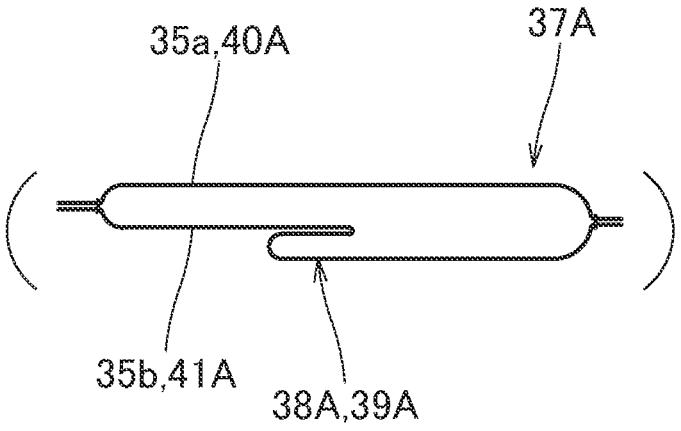

An airbag provided with tucks (or protruding regions) in the protecting portions may be configured like an airbag 35A depicted in FIG. 12. In the airbag 35A, a tuck 39A is formed of an outer wall 35*b* not provided with cut-out portions. More specifically, in the airbag 35A, the tuck 39A is formed by forming a crease extending in the up and down direction in a vicinity of the center in the front and rear direction of an outer-wall member 41A which has a greater width in the front and rear direction than an inner-wall member 40A for forming the inner wall 35*a*. The airbag 35A is formed by joining circumferential edges of the inner-wall member 40A and outer-wall member 41A together with the tuck 39A so that the tuck 39A functions as a protruding region 38A. In the airbag 35A configured as described above, the protruding region will deploy in such a manner that the protruding state recedes toward the upper end and lower end of the protecting portion 37A, in comparison with the foregoing airbag 35 in which the protruding region is disposed as protruding in an entire area in the up and down direction of the protecting portion. The protruding region 38A still protrudes partially outwardly in a middle region in the up and down direction of the protecting portion 37A since the outer wall 35*b* is given a greater film length. This protruding region 38A will also prevent the protecting portion 37A as deployed from expanding at the lower end 37*b* adequately.

Figure 13:
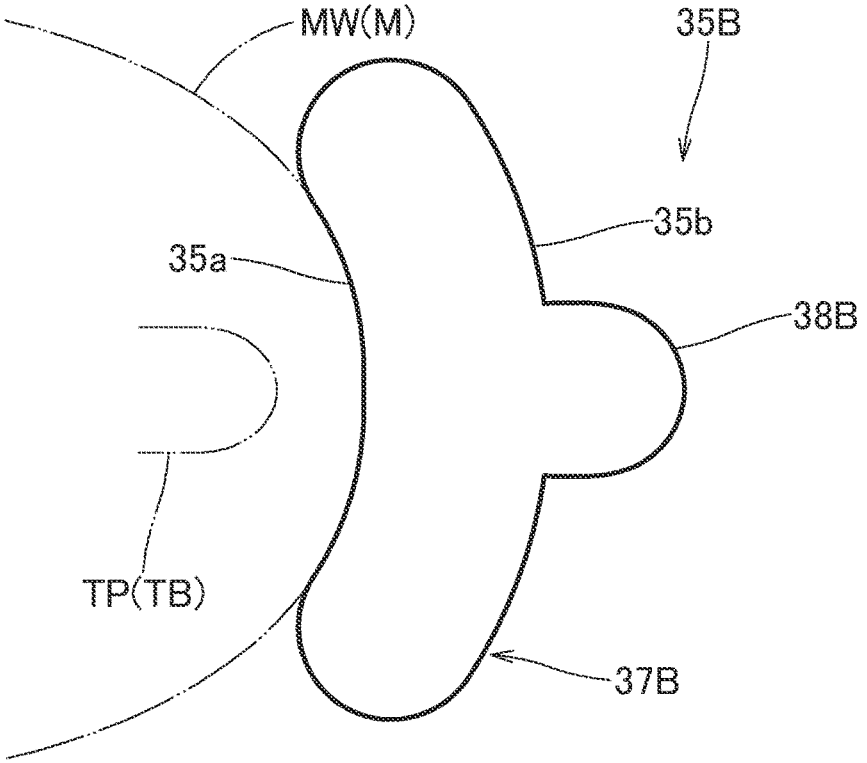
FIG. 13 is a schematic horizontal sectional view of yet another modification of the airbag as deployed in a worn state.
Figure 14:
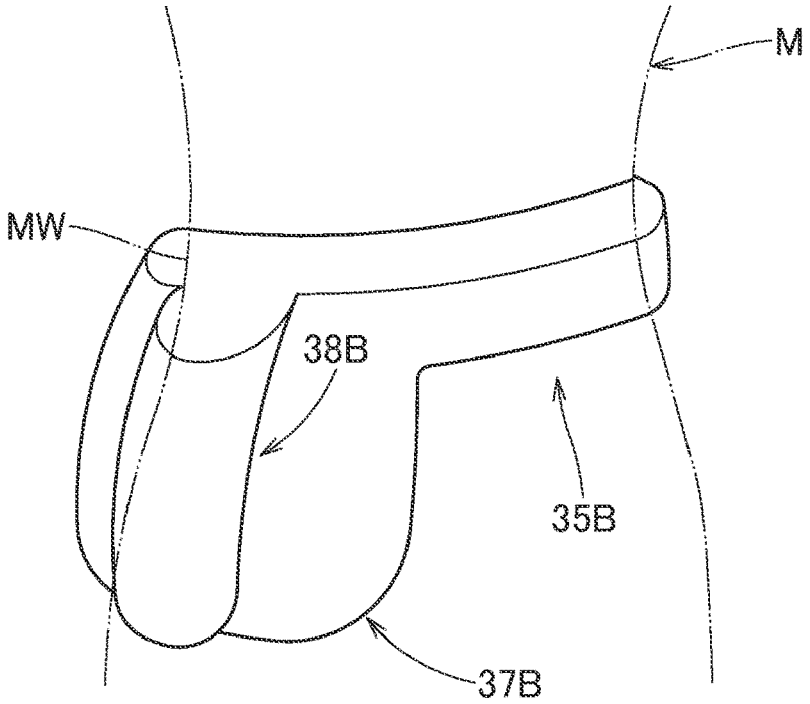
FIG. 14 is a schematic perspective view of the airbag of FIG. 13 as deployed in the worn state.

In the airbags 35 and 35A, each of the protruding regions 38, 38A is formed by lengthening a film length in the front and rear direction of the outer wall 35*b* compared to that of the inner wall 35*a* and forming a tuck 39/39A in the outer wall 35*b*. Thus the protruding region 38, 38A is configured simply. Moreover, in the protecting portion 37, 37A as laid flat, the inner wall 35*a* has a shorter length in the left and right direction (in other words, in a circumferential direction of the hip) than the outer wall 35*b*. This configuration will help tuck the lower end 37*b* of the protecting portion 37 as deployed inward, thus prevent the protecting portion 37 from expanding at the lower end 37*b*. If such advantageous effects do not have to be considered, the airbag may be formed three dimensionally so as to form a protruding region 38B which protrudes partially outwardly from the protecting portion 37B at airbag deployment, as in an airbag 35B depicted in FIGS. 13 and 14. The outer cover is omitted in FIGS. 13 and 14, too.

In the airbags 35, 35A, 35B, each of the protruding regions 38, 38A, 38B as the expansion-suppressing means is disposed in a substantially entire area in the up and down direction of the protecting portion 37, 37A, 37B. However, it will be sufficient if the protruding region has a rigidity enough to prevent the protecting portion 37, 37A, 37B from expanding at the lower end 37*b*, and therefore, the protruding region only has to be disposed at least in a region for covering an outer side of a body part above the trochanter TP (that is, a body part ranging from the pelvis MP to the trochanter TP). Accordingly, the protruding region may be configured as not to be disposed in a lower part of the protecting portion (in other words, in a region for covering the subtrochanteric region UP), as indicated with dashed-and-double-dotted lines in FIG. 10. If the protruding region 38, 38A, 38B is disposed in a substantially entire area in the up and down direction of the protecting portion 37, 37A, 37B as in the foregoing embodiments, the subtrochanteric region UP will also be covered by a thickly inflated region of the airbag.

Figure 15A:
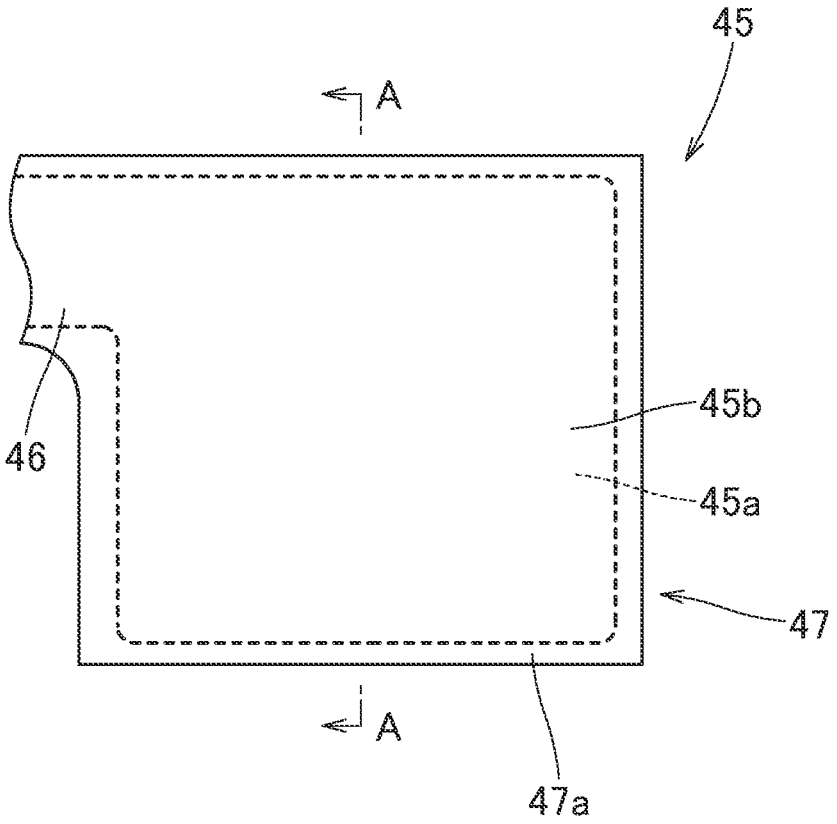
FIG. 15A is a partial enlarged plan view of yet another modification of the airbag.
Figure 15B:
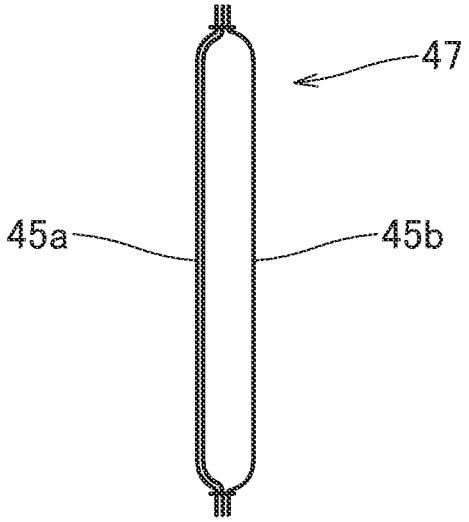
FIG. 15B is a sectional view taken along line A-A of FIG. 15A.
Figure 16:
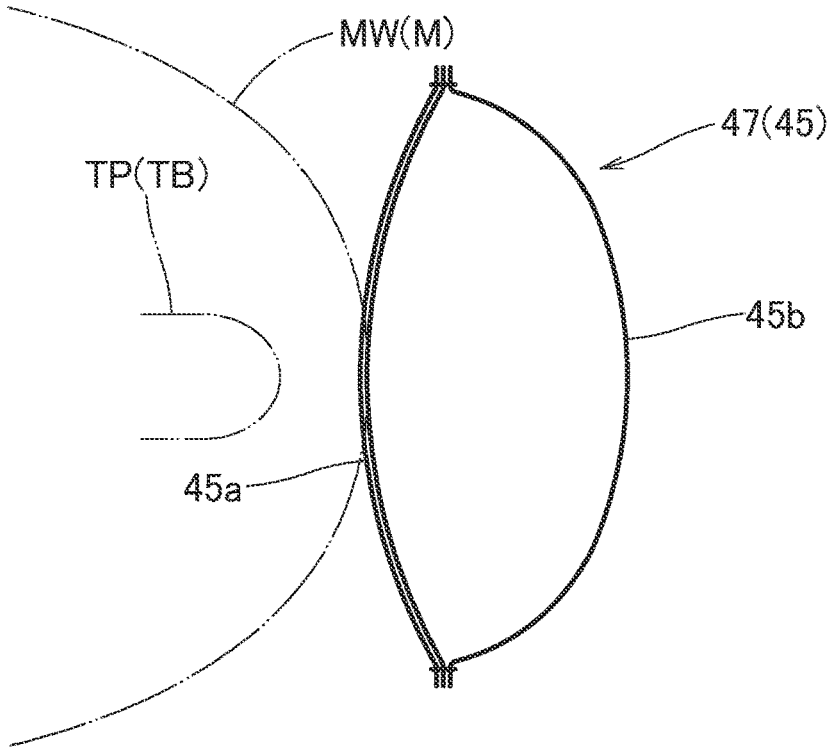
FIG. 16 is a schematic horizontal sectional view of the airbag of FIG. 15A as deployed in a worn state.
Figure 17:
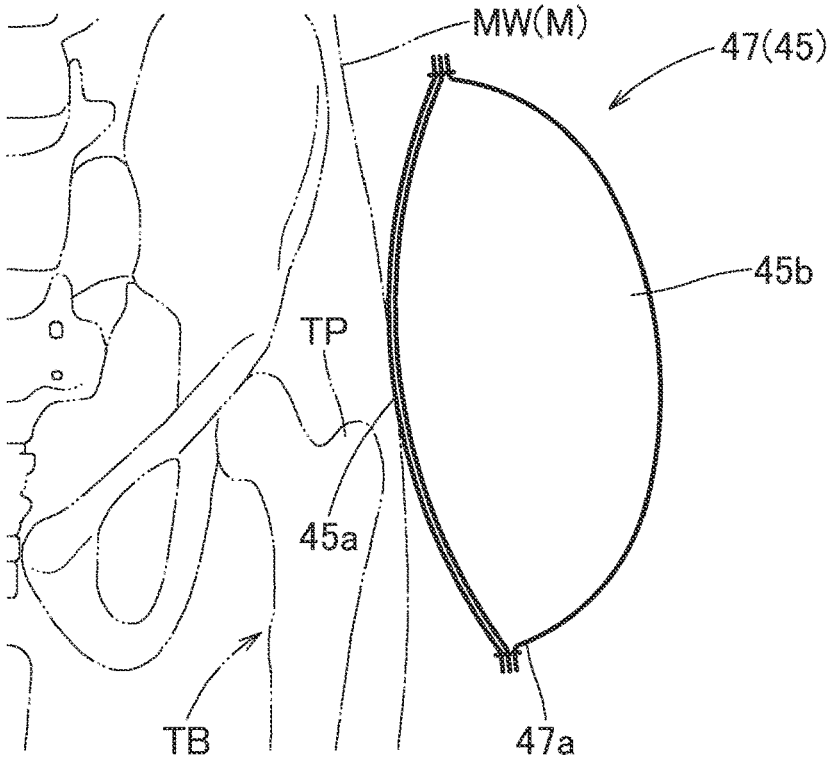
FIG. 17 is a schematic vertical sectional view of the airbag of FIG. 15A as deployed in the worn state.

The airbag may alternatively be configured like an airbag 45 depicted in FIGS. 15 to 17. Similarly to the airbags 10, 35 described above, the airbag 45 includes a mounting portion 46 that is configured to be disposed at a region to be wrapped around the pelvis MP at airbag deployment, and two protecting portions 47 each of which is configured to extend downward from the mounting portion 46 at airbag deployment. The protecting portions 47 are designed to extend downward and outwardly in the left and right direction from the mounting portion 46, in the airbag 45 as laid flat. In order to cover the trochanter TP of femur (i.e. targeted body part) and surroundings amply including regions disposed above and beneath the trochanter TP, each of the protecting portions 47 as laid flat has a substantially rectangular outer shape. The airbag 45 includes an inner wall 45*a* that is configured to be disposed towards the wearer M when worn, and an outer wall 45*b* that is configured to face away from the wearer M when worn. The inner wall 45*a* and outer wall 45*b* are identical to one another in outer shape. The airbag 45 is formed by joining outer circumferential edges of the inner wall 45*a* and outer wall 45*b*. In the airbag 45, the inner wall 45*a* has lower elongation than the outer wall 45*b*, and the inner wall 45*a* constitutes the expansion-suppressing means. More particularly, the inner wall 45*a* has a two-ply structure of a base member that is the same as a base member of the outer wall 45*a*, thus has lower elongation than the outer wall 45*b*.

With the airbag 45 configured as described above, since the outer wall 45*b* is more prone to elongate than the inner wall 45*a* at airbag deployment, the airbag 45 will be inflated in such a manner that the outer wall 45*b* curves more largely in a front and rear direction and in an up and down direction than the inner wall 45*a*, as can be seen in FIGS. 16 and 17. That is, in the airbag 45, since the inner wall 45*a* is suppressed from curving in the up and down direction at airbag deployment, the protecting portion 47 will be suppressed from flaring out and floating away from the targeted body part at the lower end 47*a*. Accordingly, the protecting portion 47 will be able to cover an outer side of the targeted body part (i.e. the trochanter TP) adequately as can be seen in FIG. 17. Although the inner wall 45*a* of this specific embodiment is made to have lower elongation than the outer wall 45*b* by having a two-ply structure of the same base member as that of the outer wall 45*a*, the configuration of the inner wall should not be limited thereby. By way of example, the inner wall may be formed of a woven fabric different from and having lower elongation than the material of the outer wall. The inner wall may alternatively be formed of a base cloth that is woven with fiber of same material as but with greater thickness (higher fineness) than that forming the outer wall, or a base cloth that is woven with fiber of same material as that of the outer wall but has higher density than the outer wall. The outer cover is omitted in FIGS. 16 and 17, too.

Figure 18A:
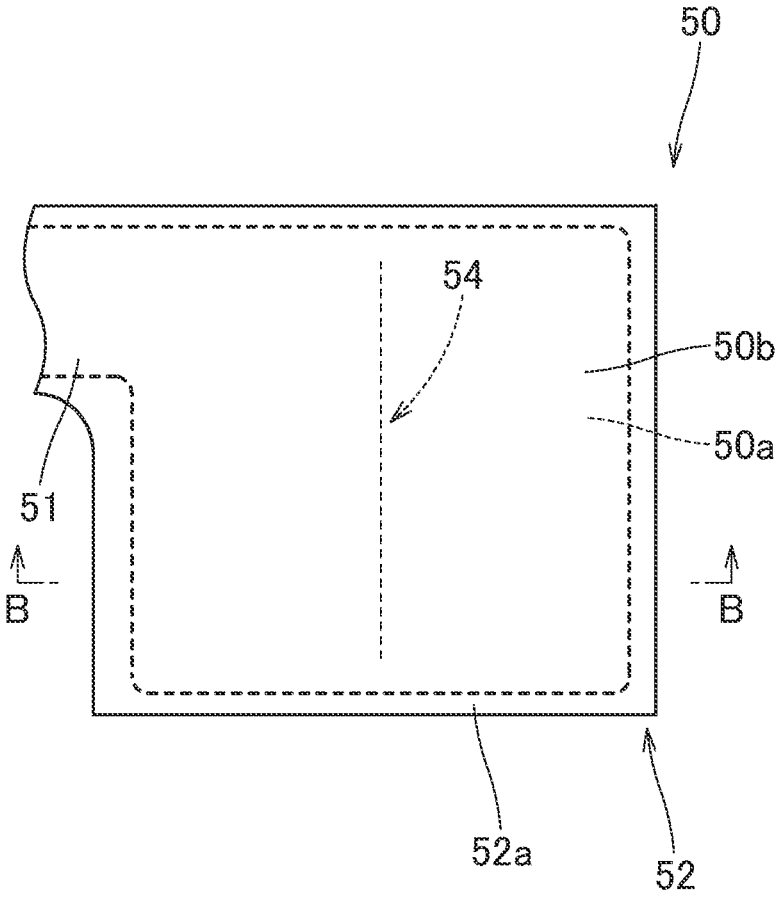
FIG. 18A is a partial enlarged plan view of yet another modification of the airbag.
Figure 18B:
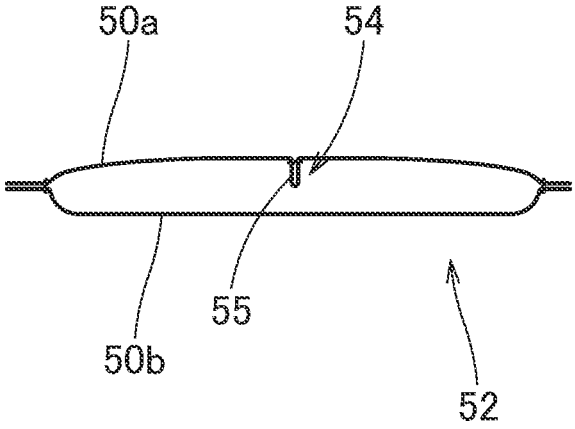
FIG. 18B is a sectional view taken along line B-B of FIG. 18A.
Figure 19:
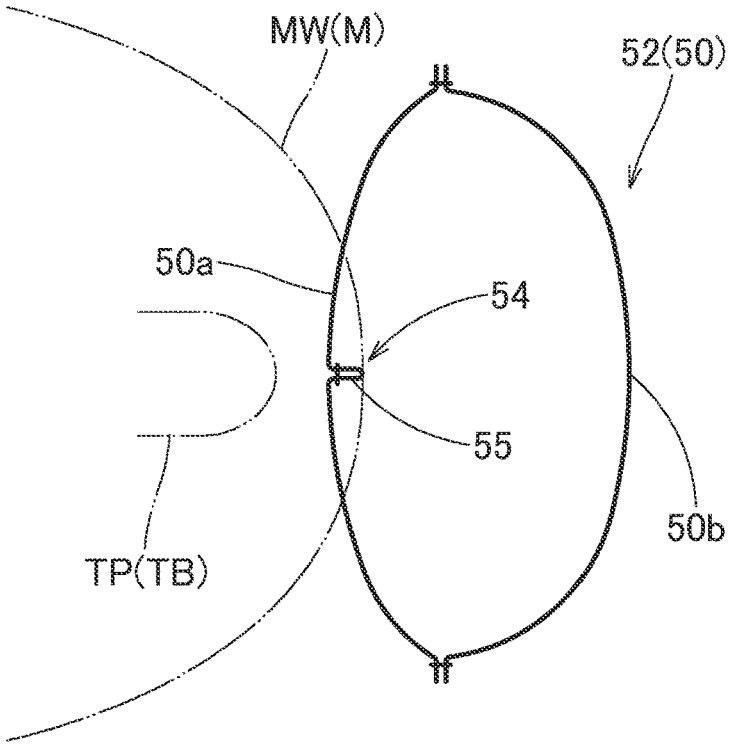
FIG. 19 is a schematic horizontal sectional view of the airbag of FIG. 18A as deployed in a worn state.
Figure 20:
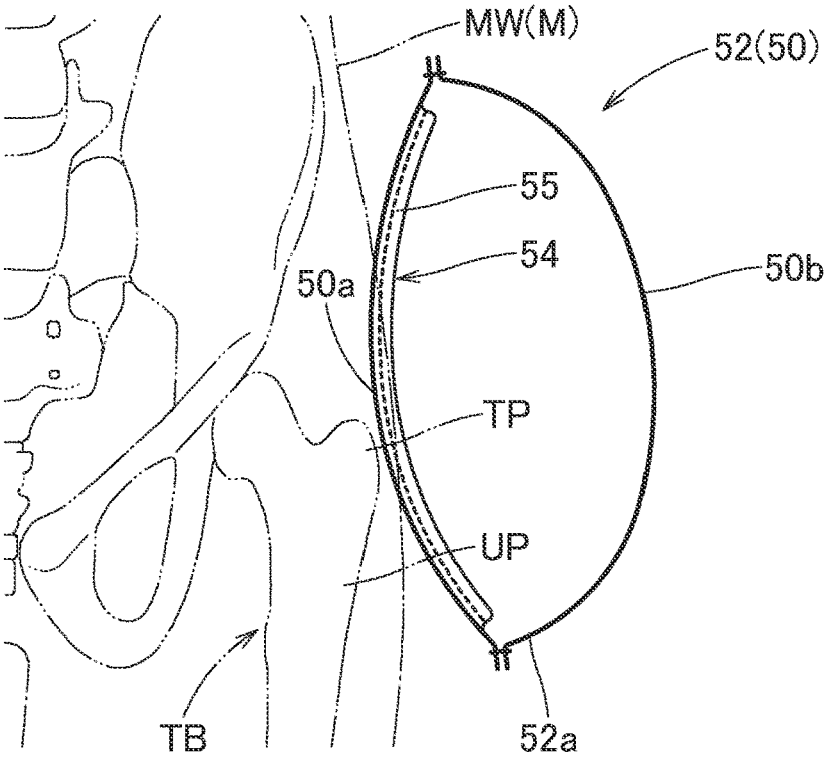
FIG. 20 is a schematic vertical sectional view of the airbag of FIG. 18A as deployed in the worn state.

The airbag may also be configured like an airbag 50 depicted in FIGS. 18 to 20. Similarly to the airbags 10, 35, 45 described above, the airbag 50 includes a mounting portion 51 that is configured to be disposed at a region to be wrapped around the pelvis MP at airbag deployment, and two protecting portions 52 each of which is configured to extend downward from the mounting portion 51 at airbag deployment. The protecting portions 52 are designed to extend downward and outwardly in the left and right direction from the mounting portion 51, in the airbag 50 as laid flat. In order to cover the trochanter (greater trochanter) TP of femur (i.e. targeted body part) and surroundings amply including regions disposed above and beneath the trochanter TP, each of the protecting portions 52 as laid flat has a substantially rectangular outer shape. Also in the airbag 50, each of the protecting portions 52 is designed to cover a side (an outer side) of the pelvis MP to the subtrochanteric region UP when worn, as shown in FIG. 20. The airbag 50 includes an inner wall 50*a* that is configured to be disposed towards the wearer M when worn, and an outer wall 50*b* that is configured to face away from the wearer M when worn. The airbag 50 includes, on the inner wall 50*a* of each of the protecting portions 52, a joined portion 54 in which two portions in the inner wall 50*a* spaced apart in a left and right direction are tucked and joined together. The joined portion 54 is continuously disposed substantially along an up and down direction as worn in the inner wall 50*a*. The joined portion 54 constitutes the expansion-suppressing means. The joined portion 54 is disposed at least in a region in the inner wall 50*a* for covering an outer side of the region disposed above the trochanter TP. In this specific embodiment, the joined portion 54 is disposed in a substantially entire area in the up and down direction of each of the protecting portions 52, as shown in FIGS. 18A and 20. More particularly, one joined portion 54 is disposed substantially at the center in the front and rear direction of each of the protecting portions 52. The joined portion 54 is formed by forming, in the inner wall 50*a*, a tuck 55 extending along the up and down direction, in such a manner as to reduce the width in the front and rear direction of the inner wall 50*a*, and sewing (joining) base portions of the tuck 55 together substantially along the up and down direction.

With the airbag 50 configured as described above, the joined portion 54 as the expansion-suppressing means, in which a portion extending substantially in the up and down direction of the inner wall 50*a* is doubled, functions like a reinforcing rib, and enhances the rigidity of a part of the inner wall 50*a*. Since the location of the joined portion 54 does not stretch easily compared with surroundings in the inner wall 50*a* or outer wall 50*b* at airbag deployment, the joined portion 54 suppresses the protecting portion 52 as deployed from expanding and floating away from the targeted body part at the lower end 52*b* adequately. Accordingly, the airbag 50 is able to cover an outer side of the targeted body part (i.e. the trochanter TP) with the protecting portion 52 adequately, as can be seen in FIG. 20. In the airbag 50, the joined portion 54 as the expansion-suppressing means is disposed in a substantially entire area in the up and down direction of the protecting portion 52. However, it will be sufficient if the joined portion has a rigidity enough to prevent the protecting portion 52 from expanding at the lower end 52*b*, and therefore, the joined portion only has to be disposed in the region for covering an outer side of the region above the trochanter TP (that is, the body part ranging from the pelvis MP to the trochanter TP). Accordingly, the joined portion may be configured as not to be disposed in a lower part of the protecting portion (in other words, in a region for covering the subtrochanteric region UP). Further, although the joined portion 54 in this specific embodiment is located at one position substantially at the center in the front and rear direction of the protecting portion 52, it will also be conceivable to arrange more than one joined portions one behind another in the protecting portion 52.

A wearable airbag device S2 in accordance with the second embodiment is now described. The wearable airbag device S2 is also configured to be wrapped around the hip MW (more particularly, around the body part above pelvis MP) of a wearer M, as can be seen in FIG. 21.

Figure 21:
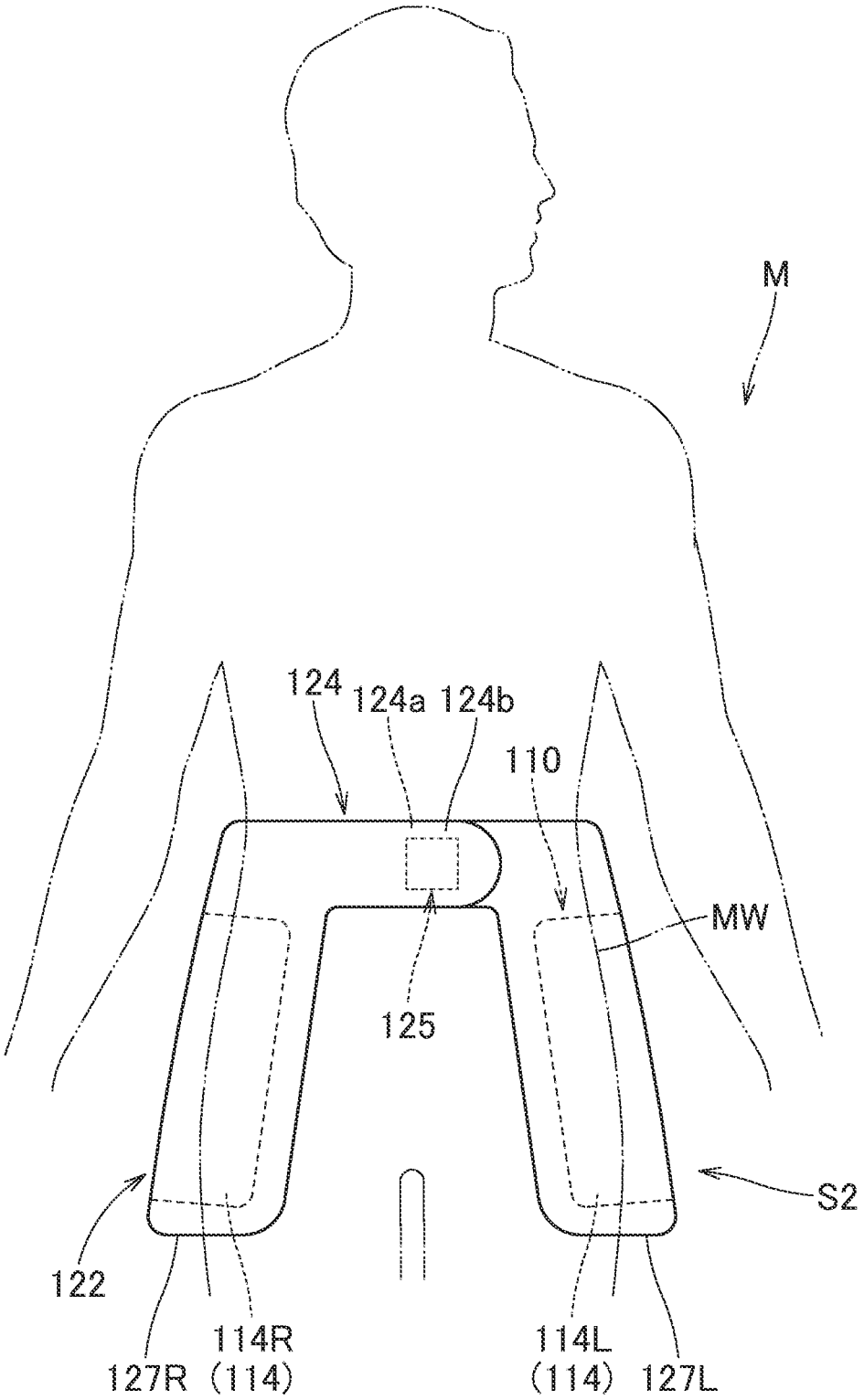
FIG. 21 schematically depicts a wearable airbag device in accordance with the second embodiment as worn by a wearer.
Figure 22:
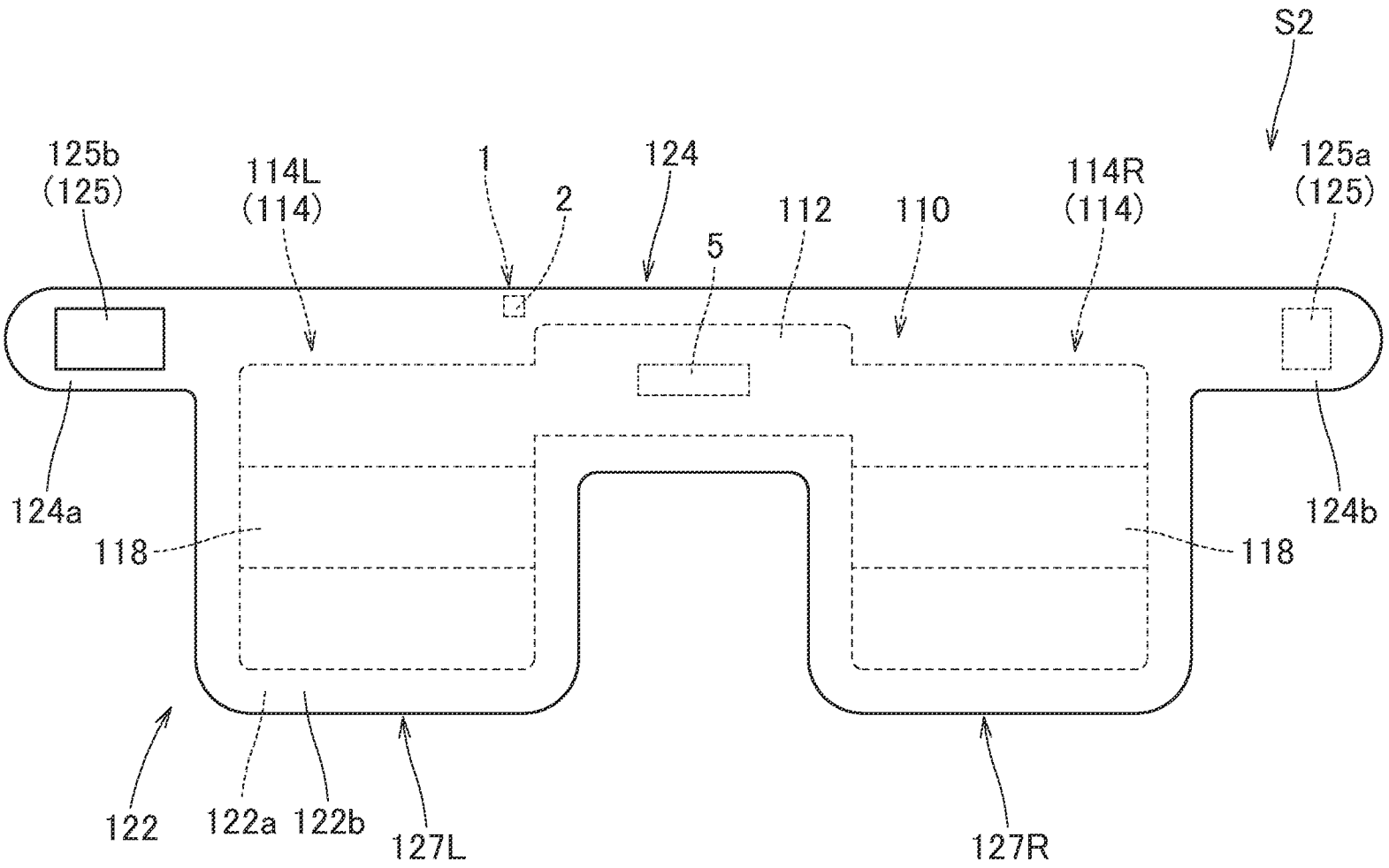
FIG. 22 is a plan view of the wearable airbag device of the second embodiment as laid flat.

As can be seen in FIGS. 21 and 22, the wearable airbag device S2 includes an airbag 110, a gas generator 5 for feeding the airbag 110 with an inflation gas, an operation control device 1 that includes a sensor part 2 for detecting a fall of the wearer M and is configured to actuate the gas generator 5, and an outer cover 122 that covers an outer circumference of the airbag 110. The operation control device 1 and the gas generator 5 have the same configurations as those of the first embodiment, respectively, and therefore, detailed description for those will be omitted. In the wearable airbag device S2 in accordance with the second embodiment, the airbag 110 is disposed inside the outer cover 122 in a developed or unfolded state with a later-described protruding inflatable portion 118 compressed, though not depicted in detail.

Figure 23:
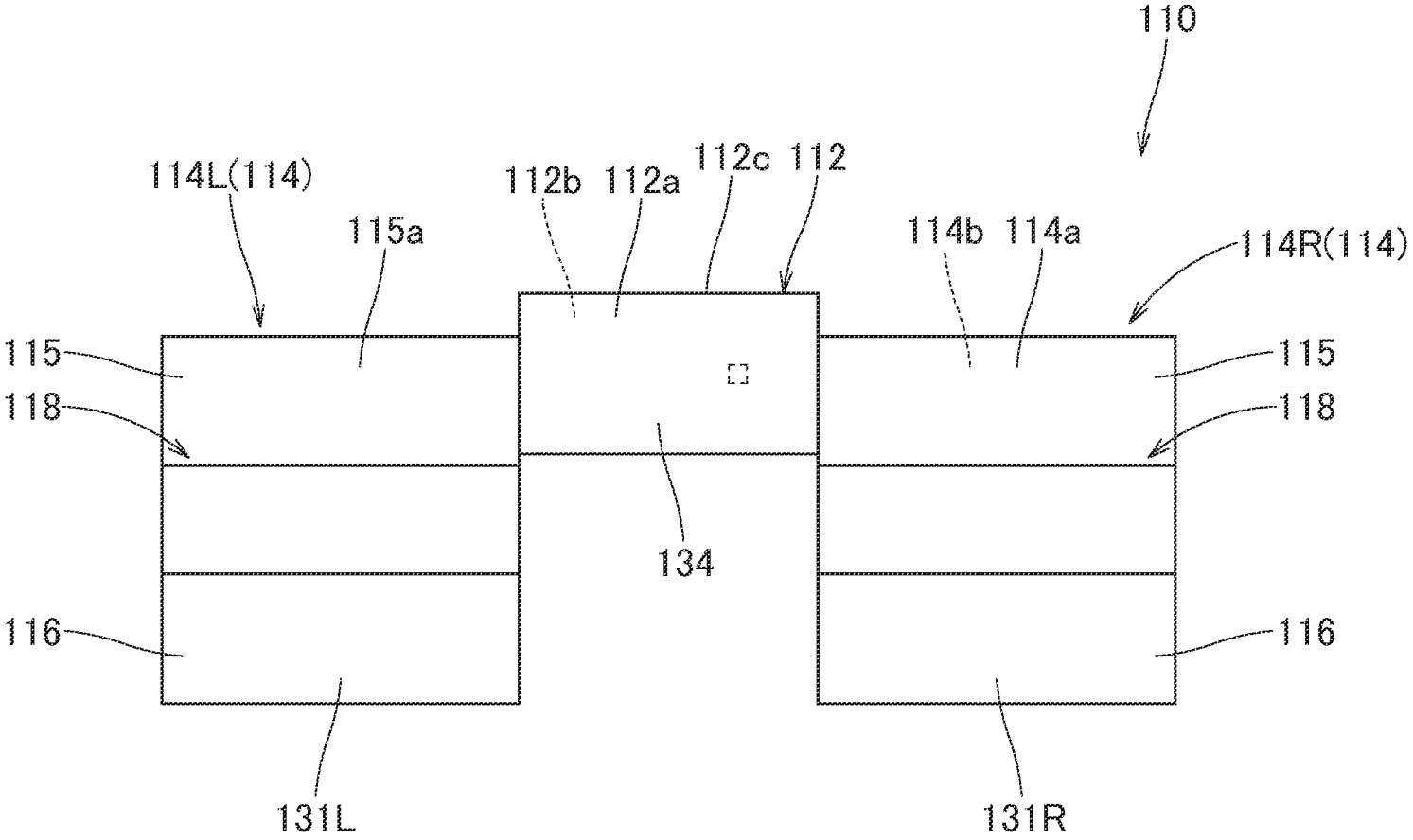
FIG. 23 is a plan view of an airbag for use in the airbag device of the second embodiment as laid flat.
Figure 24:
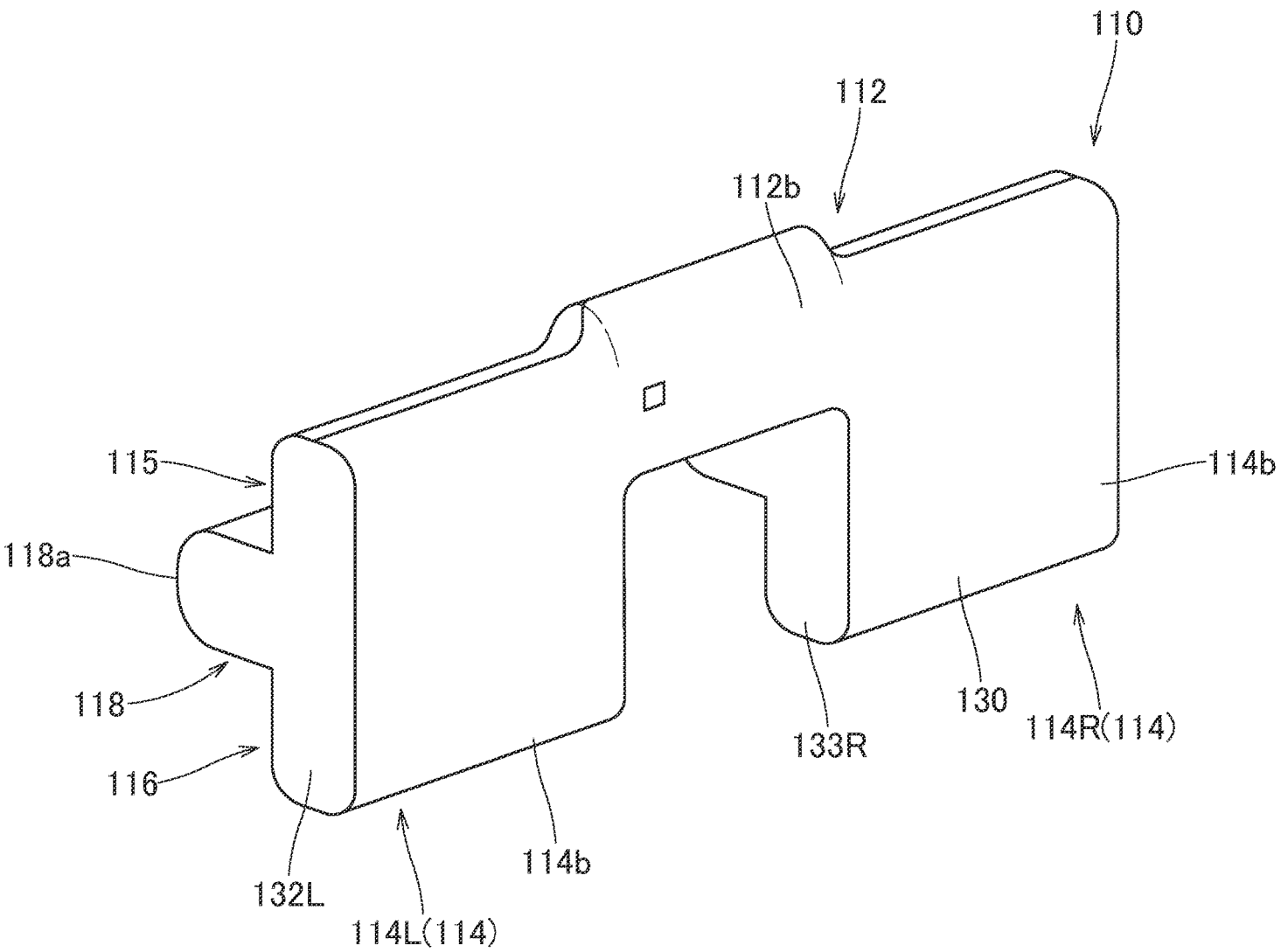
FIG. 24 is a schematic perspective view of the airbag of FIG. 23 as inflated by itself.
Figure 27:
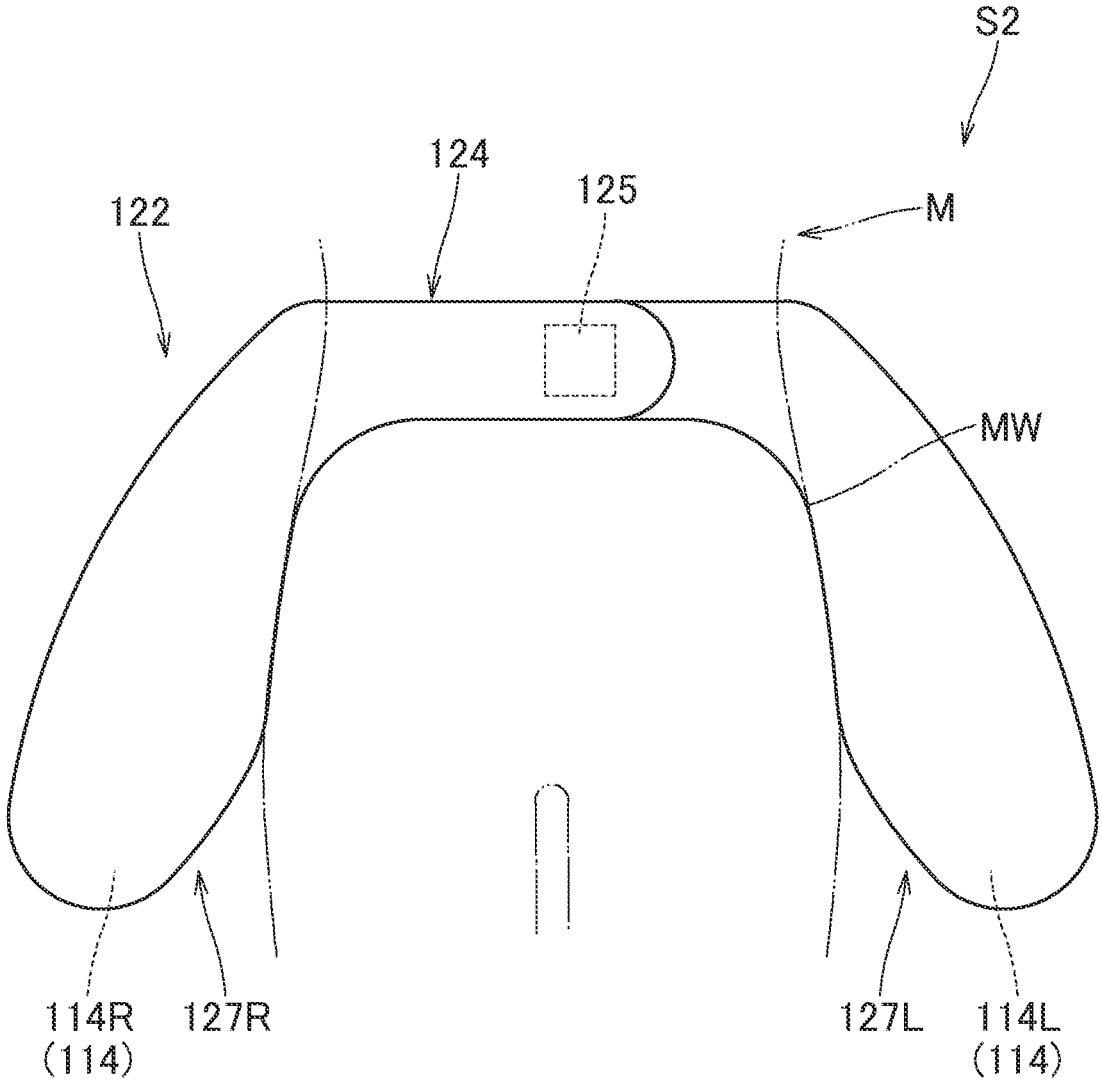
FIG. 27 schematically depicts the wearable airbag device of the second embodiment as worn by the wearer at airbag deployment.
Figure 29:
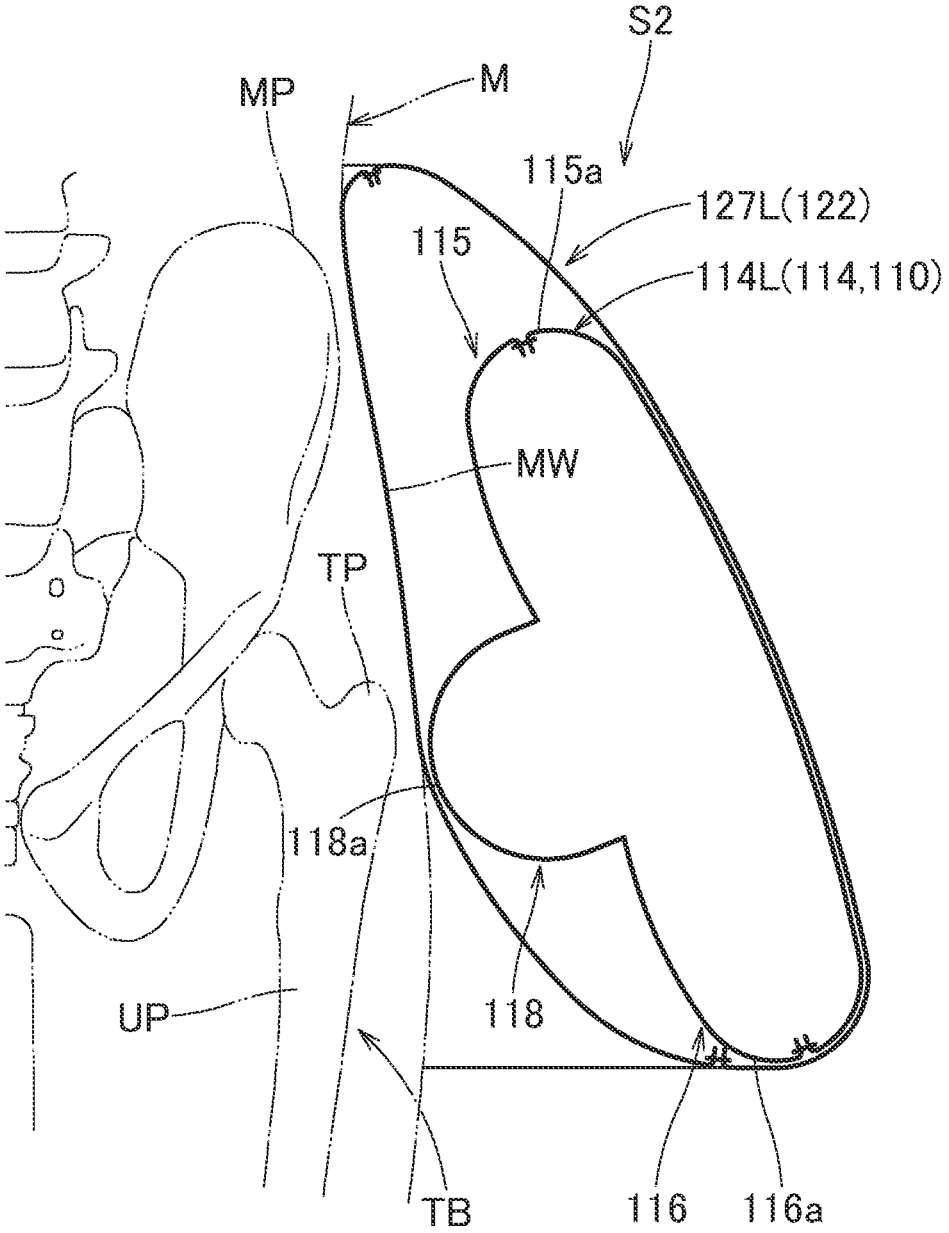
FIG. 29 is a schematic vertical sectional view of the airbag as deployed in a worn state, in the wearable airbag device of the second embodiment.

The airbag 110 is made of a sheet material having flexibility. The airbag 110 of this specific embodiment is made of a fabric woven with polyester yarns, polyamide yarns or the like. As can be seen in FIGS. 21, 27 and 29, the airbag 110 is adapted to be wrapped around the pelvis MP of the wearer M through the use of a later-described wrap portion 124 of the outer cover 122. As shown in FIGS. 23 and 24, the airbag 110 includes two protecting portions 114 (114L, 114R) that are configured to cover left and right sides of the hip MW of the wearer M (that is, a side of each of the targeted body parts), respectively, when worn, a gas-feeding path 112 that provides gas communication between the protecting portions 114 (114L, 114R) at a vicinity of upper ends 115*a* of the protecting portions 114, and a protruding inflatable portion 118 that is disposed on an inner surface of each of the protecting portions 114. The airbag 110 of this specific embodiment is bilaterally symmetrical.

The gas-feeding path 112 is designed to be inflated into a tubular shape elongated substantially along a left and right direction. The gas-feeding path 112 includes an inner wall 112*a* that is configured to be disposed in an inner side to face the wearer M when worn, and an outer wall 112*b* that is configured to face away from the wearer M when worn. The gas-feeding path 112 is formed into a tubular shape by being joined at upper edges and lower edges of the inner wall 112*a* and outer wall 112*b*. The gas-feeding path 112 is disposed inside the wrap portion 124 of the outer cover 122, as shown in FIG. 22, and is configured to be disposed at the rear of the body part above the pelvis MP at airbag deployment, though not depicted in detail. In this embodiment, the gas generator 5 is connected to the gas-feeding path 112 for feeding the airbag 110 with an inflation gas, as shown in FIG. 22.

Figure 25:
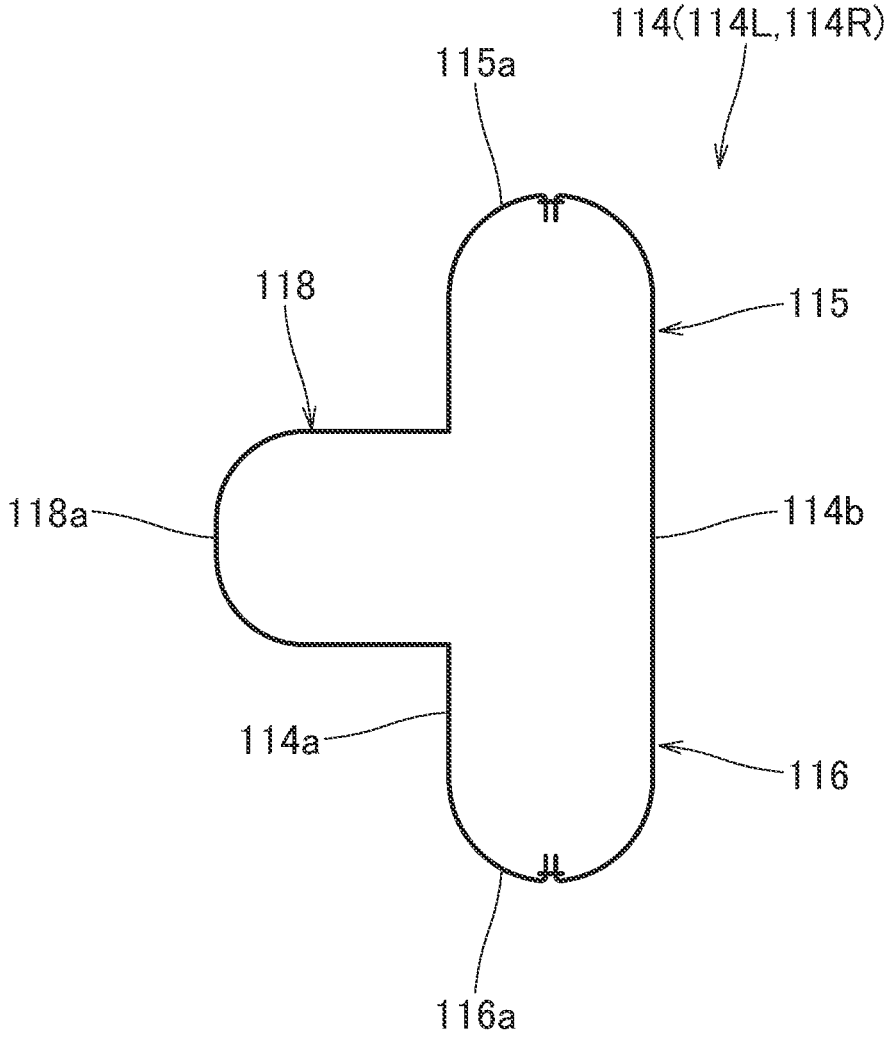
FIG. 25 is a schematic vertical sectional view of the airbag of FIG. 23 as inflated by itself.

Each of the protecting portions 114 (114L, 114R) is designed such that the upper end (or an upper end 115*a* of a later-described upper region 115) is disposed at a slightly farther downward position than the upper edge 112*c* of the gas-feeding path 112, in a stepped manner with respect to the gas-feeding path 112, as can be seen in FIGS. 23 and 24. In order to cover the trochanter TP of femur as the targeted body part amply in the up and down directions and in the front and rear direction when worn, each of the protecting portions 114 (114L, 114R) is designed to be inflated into a substantially rectangular board shape which has a greater width in the up and down direction than that in the front and rear direction. Each of the protecting portions 114 includes an inner wall 114*a* that is disposed in the inner side to face the wearer M when worn, and an outer wall 114*b* that is configured to face away from the wearer M when worn, as can be seen in FIGS. 23 and 25. More particularly, each of the protecting portions 114 (114L, 114R) is configured to cover a side (an outer side) of a body part ranging from a lower half region of the pelvis MP to the subtrochanteric region UP when worn, as can be seen in FIG. 29.

The protruding inflatable portion 118 is disposed on an inner surface (i.e. on the inner wall 114*a*) of each of the protecting portions 114 (114L, 114R) as worn. Each of the protruding inflatable portions 118 is located substantially at the center in the up and down direction of the protecting portion 114 in such a manner as to extend continuously substantially along the front and rear direction (in other words, substantially along the width direction of the protecting portion 114). As can be seen in FIG. 29, each of the protruding inflatable portions 118 is configured to be deployed at the position corresponding to the trochanter TP at airbag deployment when worn. The protruding inflatable portion 118 of this specific embodiment is formed in an entire region in the width direction of the protecting portion 114 (that is, in an entire region in a circumferential direction of the hip MW of the wearer M in the protecting portion 114), as can be seen in FIG. 23. Even more particularly, the protruding inflatable portion 118 of this specific embodiment is configured to protrude substantially perpendicularly to the protecting portion 114 as inflated in a board shape at airbag deployment. In a state where the airbag 110 is inflated by itself, the thickness of each of the protruding inflatable portions 118 is slightly greater than the thickness of the protecting portion 114, and the protruding amount of the protruding inflatable portion 118 from the protecting portion 114 is substantially the same as the width in the up and down direction of an upper region 115 of the protecting portion 114 which is disposed above the protruding inflatable portion 118 or a lower region 116 of the protecting portion 114 which is disposed beneath the protruding inflatable portion 118, as can be seen in FIG. 25. That is, the protruding inflatable portion 118 is designed so that the leading end 118*a* is located farther inward than the upper region 115 that is disposed in a vicinity of an upper end region of the protecting portion 114 at airbag deployment. In other words, the protruding inflatable portion 118 is designed so that the leading end 118*a* is located farther inward than the upper end region of the protecting portion 114 at airbag deployment, as can be seen in FIG. 29.

Figure 28:
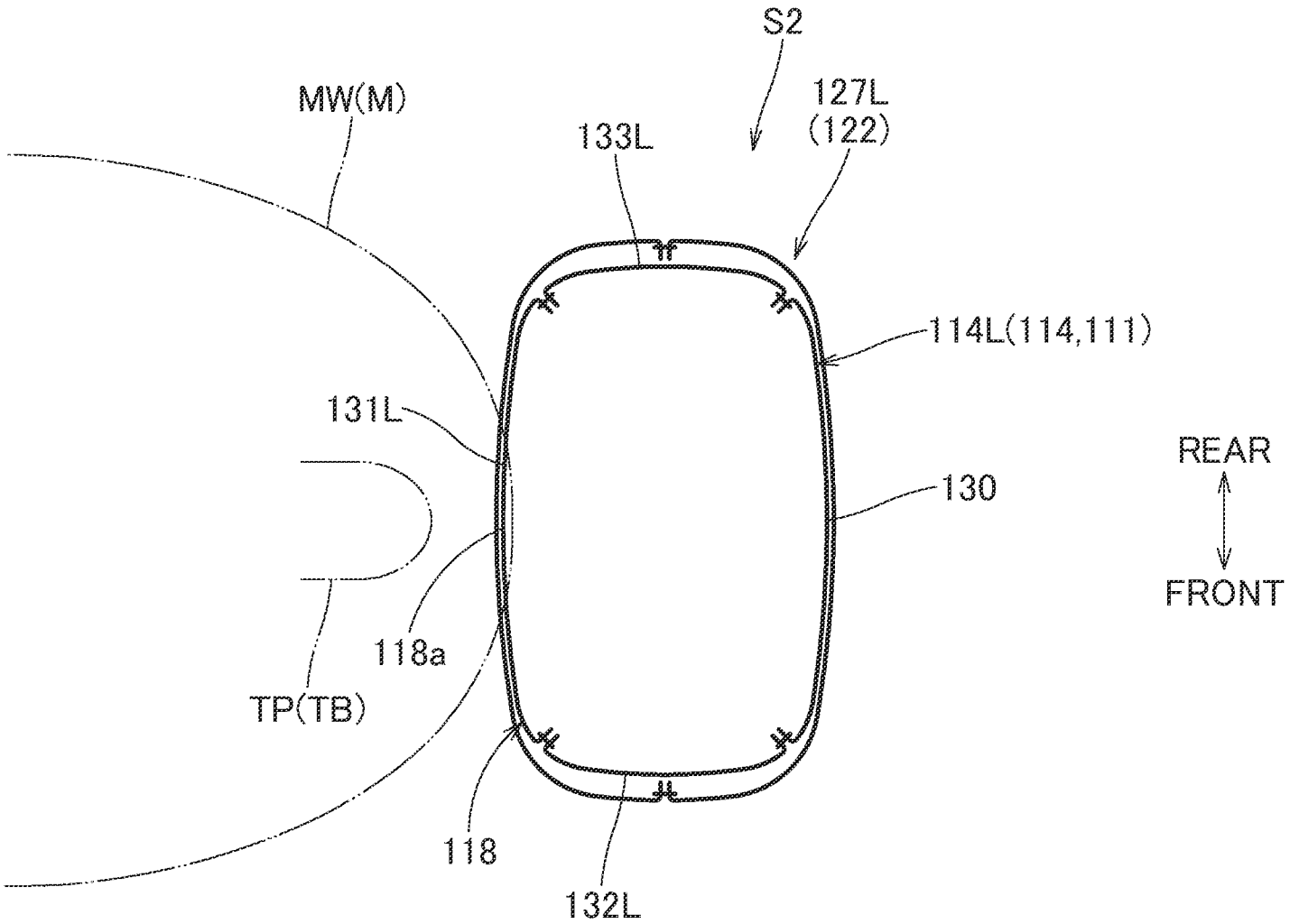
FIG. 28 is a schematic partial horizontal sectional view of the airbag as deployed taken along a front and rear direction in the wearable airbag device of the second embodiment. More particularly.

When the airbag 110 is deployed as worn by the wearer M, each of the protecting portions 114 (114L, 114R) covers an outer side of the trochanter TP as the targeted body part amply in the front and rear direction and in the up and down direction, as can be seen in FIGS. 28 and 29. More specifically, each of the protecting portions 114 (114L, 114R) is deployed in such a manner as to flare out toward the lower end 116*a* with the upper end 115*a* located in proximity to the hip MW at a side of the pelvis MP. At this time, the protruding inflatable portion 118 contacts the wearer M at an outer side of the trochanter TP by the leading end 118*a* surface through the intervention of the outer cover 122, as shown in FIG. 29. In the meantime, the lower region (extended region) 116 of the protecting portion 114 that extends farther downwardly than the protruding inflatable portion 118 covers a side of the subtrochanteric region UP of femur TB, as shown in FIG. 29.

Figure 26:
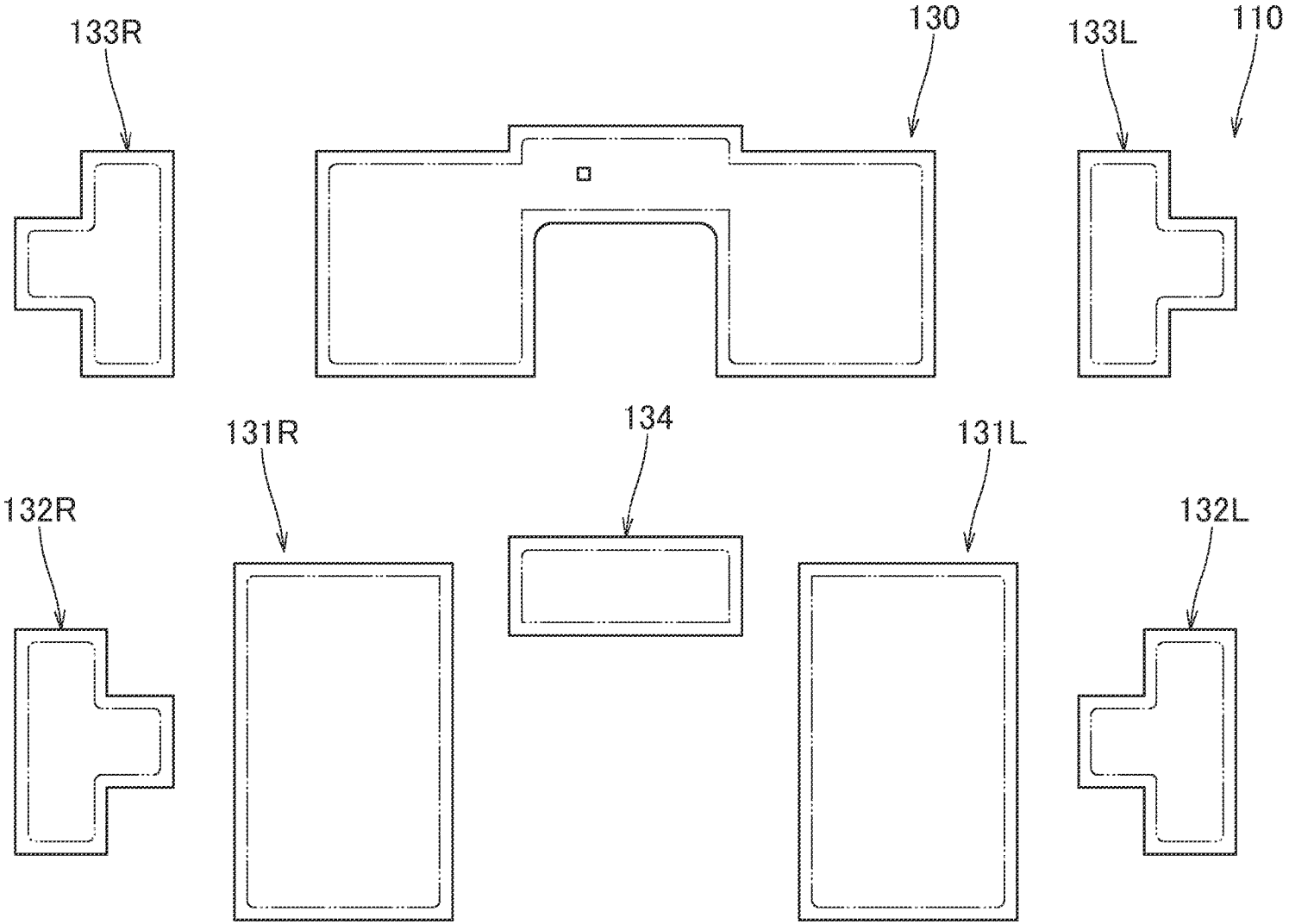
FIG. 26 depicts base members of the airbag of FIG. 23 in plan.

The airbag 110 of this specific embodiment is formed by joining together circumferential edges of a plurality of base members depicted in FIG. 26. More specifically, the airbag 110 is composed of an outer panel 130 which forms the outer walls 114*b* of the protecting portions 114L, 114R and outer wall 112*b* of the gas-feeding path 112, two inner panels 131L, 131R each of which forms the inner wall 114*a* of the protecting portion 114L/114R and an outer shell of the protruding inflatable portion 118, two end panels 132L, 132R each of which forms the front (when worn) end surface of the protecting portion 114L/114R and protruding inflatable portion 118, two end panels 133L, 133R each of which forms the rear (when worn) end surface of the protecting portion 114L/114R and protruding inflatable portion 118, and an inner panel 134 which forms the inner wall 112*a* of the gas-feeding path 112, as can be seen in FIGS. 23, 24 and 26.

The outer cover 122 is made of a flexible woven fabric having better touch than the base cloths of the airbag 110. The outer cover 122 covers an entirety of the outer circumference of the airbag 110. The outer cover 122 includes an inner wall 122*a* that is disposed in the inner side (i.e. towards the wearer M) when worn, and an outer wall 122*b* that is disposed on the outer side when worn, and is formed into a bag by being jointed (or sewn) together by circumferential edges of the inner wall 122*a* and outer wall 122*b*. As can be seen in FIGS. 21 and 22, the outer cover 122 includes a wrap portion 124 that is formed substantially into a band so as to be wrapped around the body part right above the pelvis MP of the wearer M, and two main covering portions 127L, 127R that extend downward from the wrap portion 124 and cover the outer circumferences of the protecting portions 114L, 114R, respectively. As described above, the gas-feeding path 112 of the airbag 110 and the gas generator 5 are stored inside a central portion of the wrap portion 124. The wrap portion 124 is designed to protrude farther outwardly in the left and right direction than the main covering portions 127L, 127R, and provided with a fastening means at the opposite ends 124*a*, 124*b*. The fastening means in this embodiment is composed of a hook-and-loop fastener 125 including hooks 125*a* and loops 125*b* engageable with one another so as to fasten the ends 124*a* and 124*b* of the wrap portion 124 together. The hook-and-loop fastener 125 enables the wearer M to wear the airbag device S2 easily according to the size of the waist. An outer shape of each of the main covering portions 127L, 127R as laid flat is greater than the protecting portion 114 so as to allow the protecting portion 114 to inflate smoothly there inside.

As can be seen in FIG. 21, the wearable airbag device S2 in accordance with the second embodiment is worn by the wearer M in a wrapping manner around the hip MW (more particularly, around a constricted body part right above the pelvis MP) of the wearer M, by fastening the opposite ends 124*a*, 124*b* of the wrap portion 124 of the outer cover 122 with the use of the hook-and-loop fastener 125 as the fastening means. If the sensor part 2 detects a falling behavior of the wearer M as wearing the airbag device S2, the operation control device 1 sends an actuating signal to the gas generator 5, the gas generator 5 feeds an inflation gas to the airbag 110, so that the airbag 110 is deployed as shown in FIGS. 27 to 29.

The wearable airbag device S2 in accordance with the second embodiment includes the protruding inflatable portion 118 that is configured to protrude from the inner surface (inner wall 114*a*) of each of the protecting portions 114 and be deployed in proximity to the trochanter TP of femur (i.e. the targeted body part) at airbag deployment. Accordingly, the protruding inflatable portion 118 is able to cover and protect the trochanter TP and surroundings quickly and adequately at fall of the wearer M. Especially, in the wearable airbag device S2 of the second embodiment, the protruding inflatable portion 118 is configured to contact the wearer M by the leading end 118*a* surface through the intervention of the outer cover 122, so that a thickly inflated portion composed of the protruding inflatable portion 118 and protecting portion 114 covers the outer side of the trochanter TP directly with no gap interposed, as can be seen in FIGS. 28 and 29. Accordingly, the wearable airbag device S2 is able to cushion and protect the trochanter TP and surroundings adequately from the surface such as floor and ground with the thickly inflated portion (i.e. the protruding inflatable portion 118 and protecting portion 114) at fall of the wearer M.

Therefore, the wearable airbag device S2 in accordance with the second embodiment is able to protect the hip MW of the wearer M in a steady fashion.

In the wearable airbag device S2 of the second embodiment, moreover, each of the protecting portions 114 includes the lower region (extended region) 116 that extends farther downwardly than the protruding inflatable portion 118. With this lower region (extended region) 116, the airbag 110 is able to protect the subtrochanteric region UP as well from the surface such as the floor and ground. If such an advantageous effect does not have to be considered, the airbag may be formed without an extended region.

Figure 30:
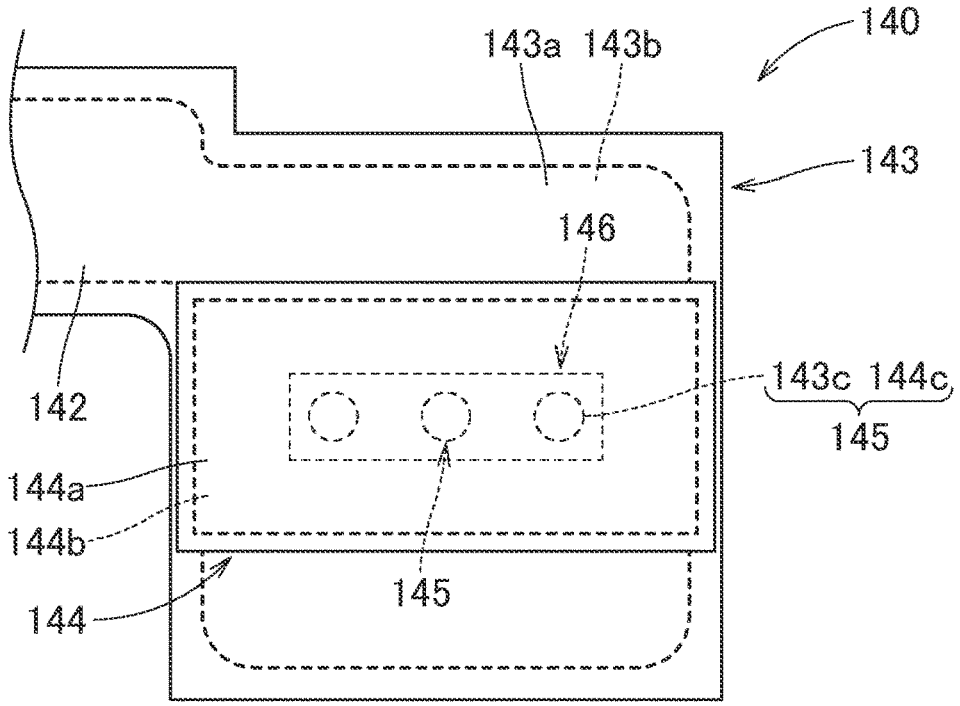
FIG. 30 is a partial enlarged bottom view of a modification of the airbag of the second embodiment.
Figure 31:
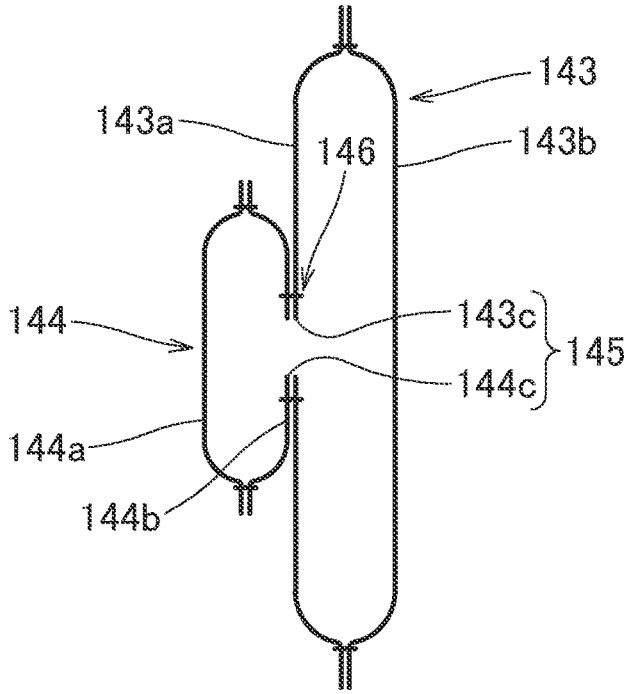
FIG. 31 is a schematic vertical sectional view of the airbag of FIG. 30.
Figure 32:
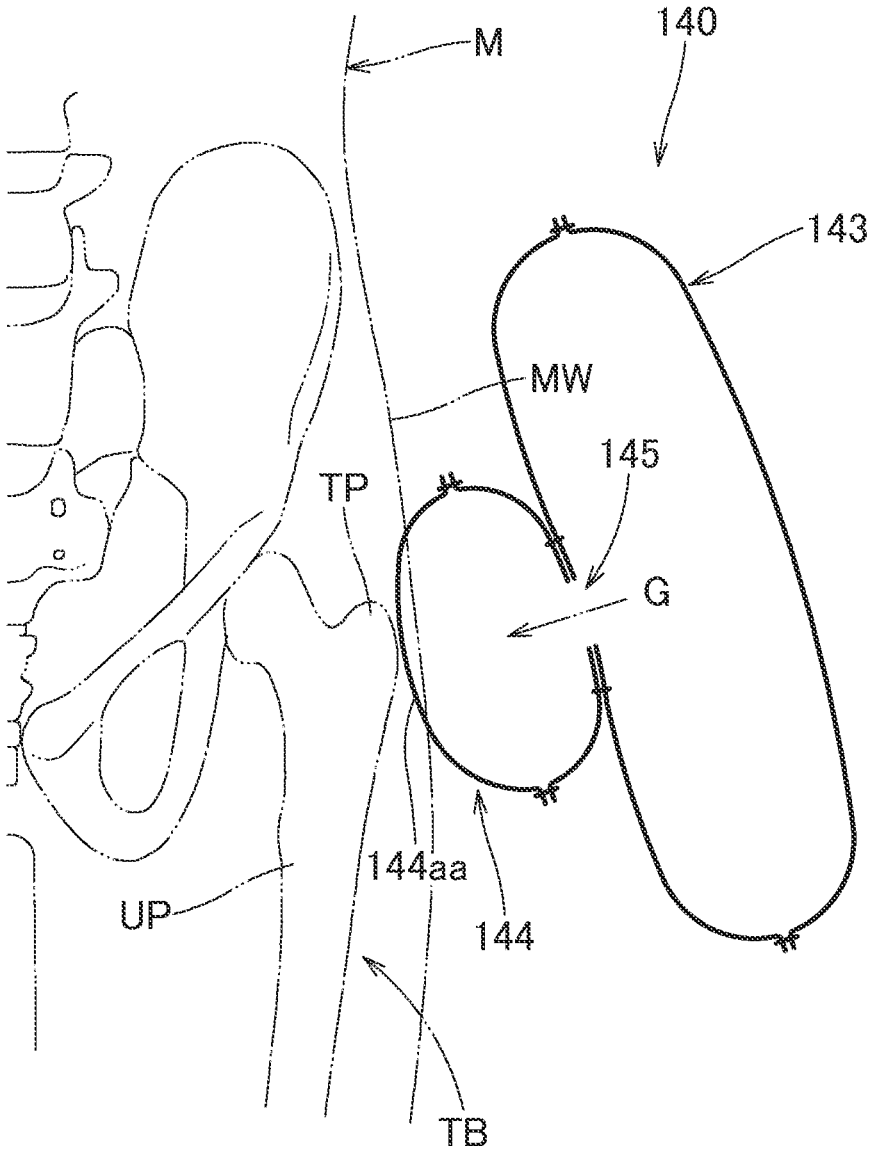
FIG. 32 is a schematic vertical sectional view of the airbag of FIG. 30 as deployed in a worn state.

The airbag may alternatively be configured like an airbag 140 depicted in FIGS. 30 to 32. Although not depicted in detail, similarly to the airbag 110 described above, the airbag 140 includes two protecting portions 143 that are configured to cover left and right sides of the hip MW of the wearer M, respectively, at airbag deployment, a gas-feeding path 142 that provides gas communication between the protecting portions 143 at a vicinity of upper ends of the protecting portions 143, and a protruding inflatable portion 144 that is disposed on an inner surface of each of the protecting portions 143. The protruding inflatable portion 144 of the airbag 140 is composed of an inflatable bag formed separately from the protecting portion 143. The airbag 140 is bilaterally symmetrical, too, though not depicted in detail.

Each of the protecting portions 143 includes an inner wall 143*a* that is configured to be disposed towards the wearer M when worn, and an outer wall 143*b* that is configured to be disposed on the outer side when worn, and formed by being sewn (jointed) together by circumferential edges of the inner wall 143*a* and outer wall 143*b*. The inner wall 143*a* and outer wall 143*b* are substantially identical in outer shape. The protecting portion 143 is designed to be inflated into a substantially rectangular board shape that has a greater width in an up and down direction than that in a front and rear direction. The inner wall 143 is provided, substantially at the center in the up and down direction, with a communicating portion 145 by which the protruding inflatable portion 144 and protecting portion 143 communicate with one another. The communicating portion 145 is composed of a plurality of (three, in this embodiment) holes 143*c* that are arranged along the width direction (the front and rear direction when worn) of the protecting portion 143. Each of the holes 143*c* is substantially round.

The protruding inflatable portion 144 is composed of an inflatable bag separate from the protecting portion 143, and is disposed in the inner surface (in the inner wall 143*a*) of the protecting portion 143. The protruding inflatable portion 144 is located substantially at the center in the up and down direction of the protecting portion 143, and is designed to be inflated substantially into a rod shape extending in the front and rear direction (in the width direction) of the protecting portion 143. The protruding inflatable portion 144 is disposed in an entire region in the width direction of the protecting portion 143 (that is, in an entire region in a circumferential direction of the hip MW of the wearer M in the protecting portion 143). The protruding inflatable portion 144 includes an inner wall 144*a* that is configured to be disposed towards the wearer M when worn, and an outer wall 144*b* that is configured to be disposed on the outer side when worn, and is formed by being sewn (jointed) together by circumferential edges of the inner wall 144*a* and outer wall 144*b*. The outer wall 144*b* facing the protecting portion 143 is provided with holes 144*c* that correspond to the holes 143*c* of the protecting portion 143 and constitute the communicating portion 145. The protruding inflatable portion 144 and protecting portion 143 are coupled together by a seam 146 that sews the inner wall 143*a* and outer wall 144*b* together with sewing threads in the periphery of the communicating portion 145. That is, the communicating portion 145 is formed by cutting a part each of the inner wall 143*a* of the protecting portion 143 and outer wall 144*b* of the protruding inflatable portion 144 substantially at the center in the up and down direction of the protecting portion 143. With this configuration, an inflation gas which flows into the protecting portion 143 inflates the protecting portion 143 first, then flows toward the inner wall 144*a* of the protruding inflatable portion 144 (i.e. toward the wearer M or toward the trochanter TP) via the communicating portion 145, as can be seen in FIG. 32.

The airbag 140 configured as described above can be produced easier than the airbag 110 in which the protruding inflatable portion 118 is integral with the protecting portion 114. In the airbag 140, especially, each of the protruding inflatable portion 144 and protecting portion 143 is formed by sewing (joining) together circumferential edges of the outer wall 143*b*/144*b* and inner wall 143*a*/144*a* which are identical in outer shape. That is, since the airbag 140 is formed by planar sewing (joining) work, the airbag 140 is easy to produce. With the airbag 140, moreover, since the communicating portion 145 is configured to make the inflation gas G having flown into the protecting portion 143 flow toward the inner wall 144*a* of the protruding inflatable portion 144 facing the trochanter TP, i.e. toward a protruding top 144*aa* (FIG. 32), the protruding inflatable portion 144 will be inflated quickly to cover the outer side of the trochanter TP. Furthermore, since the protruding top 144*aa* keeps disposed in proximity to the trochanter TP from a standby state to deployment of the protruding inflatable portion 144, a portion of the protruding inflatable portion 144 for receiving the trochanter TP at fall of the wearer M (i.e. the protruding top 144*aa*) will be disposed in proximity to the trochanter TP and surroundings without slippage. The outer cover is omitted in FIG. 32.

Figure 33:
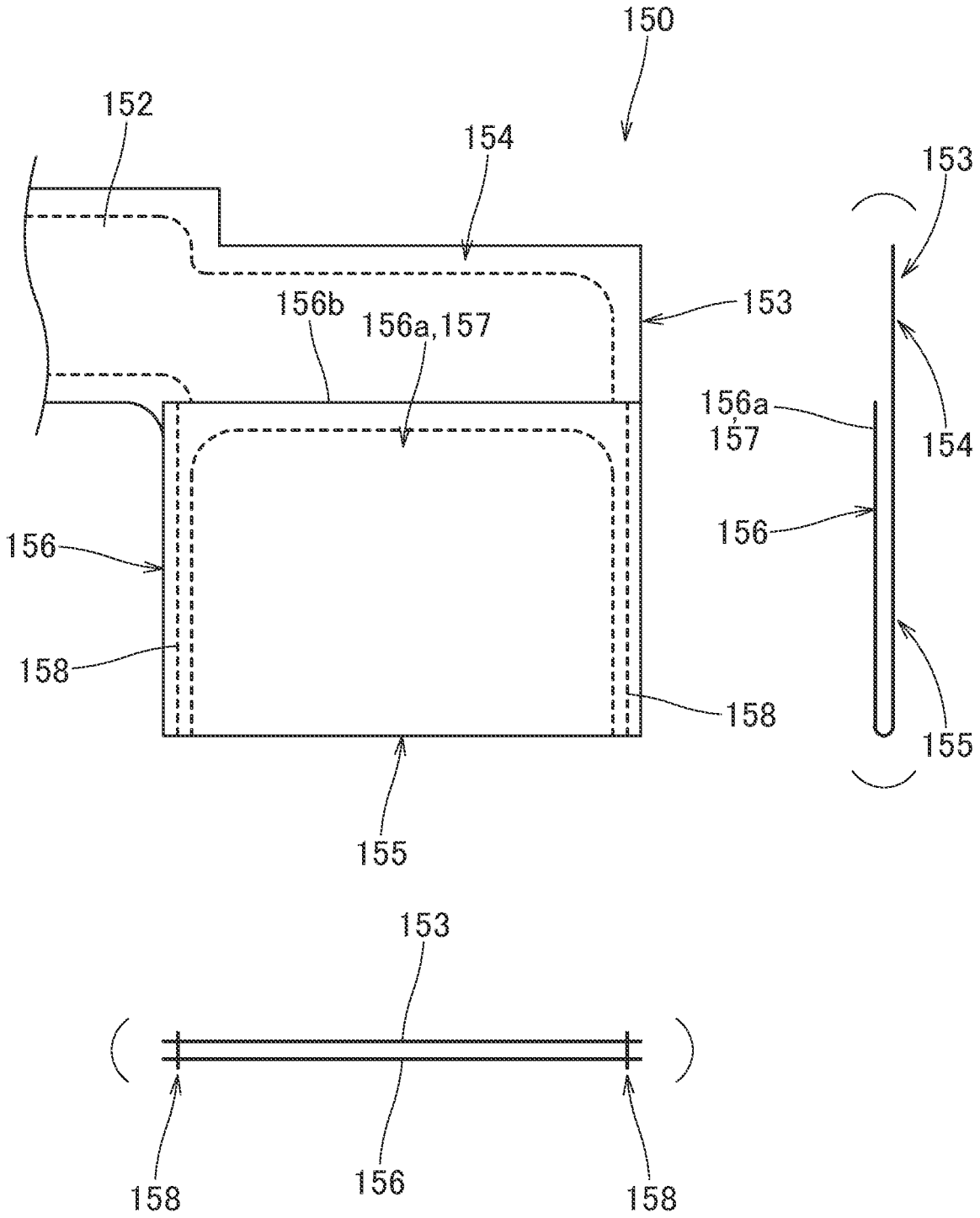
FIG. 33 is a partial enlarged bottom view of another modification of the airbag of the second embodiment.
Figure 35:
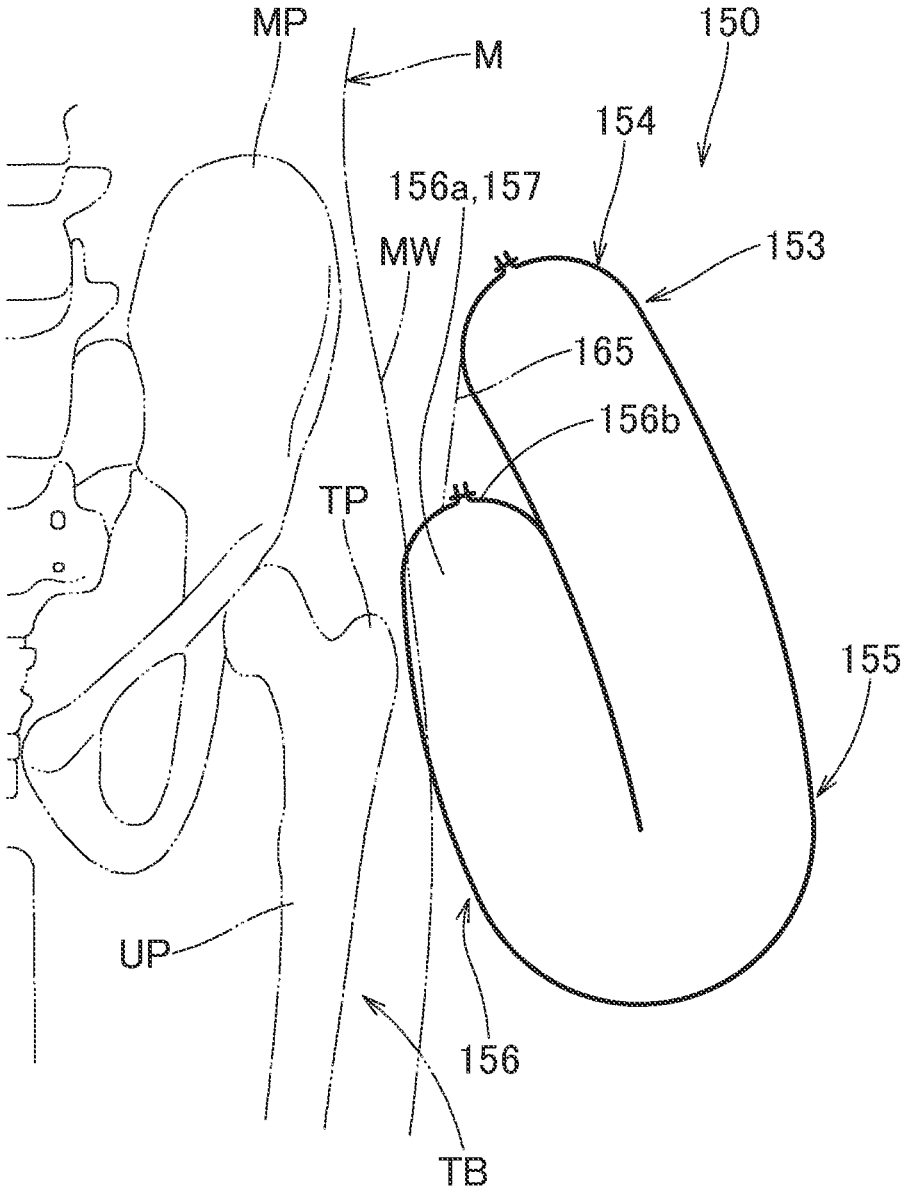
FIG. 35 is a schematic vertical sectional view of the airbag of FIG. 33 as deployed in a worn state.

The airbag may further alternatively be configured like an airbag 150 depicted in FIGS. 33 and 35. Although not depicted in detail, similarly to the airbag 110 described above, the airbag 150 includes two protecting portions 153 that are configured to cover left and right sides of the hip MW of the wearer M, respectively, at airbag deployment, a gas-feeding path 152 that provides gas communication between the protecting portions 153 at a vicinity of upper ends of the protecting portions 153, and a protruding inflatable portion 157 that is disposed on an inner surface of each of the protecting portions 153. The airbag 150 is bilaterally symmetrical, too, though not depicted in detail.

Figure 34:
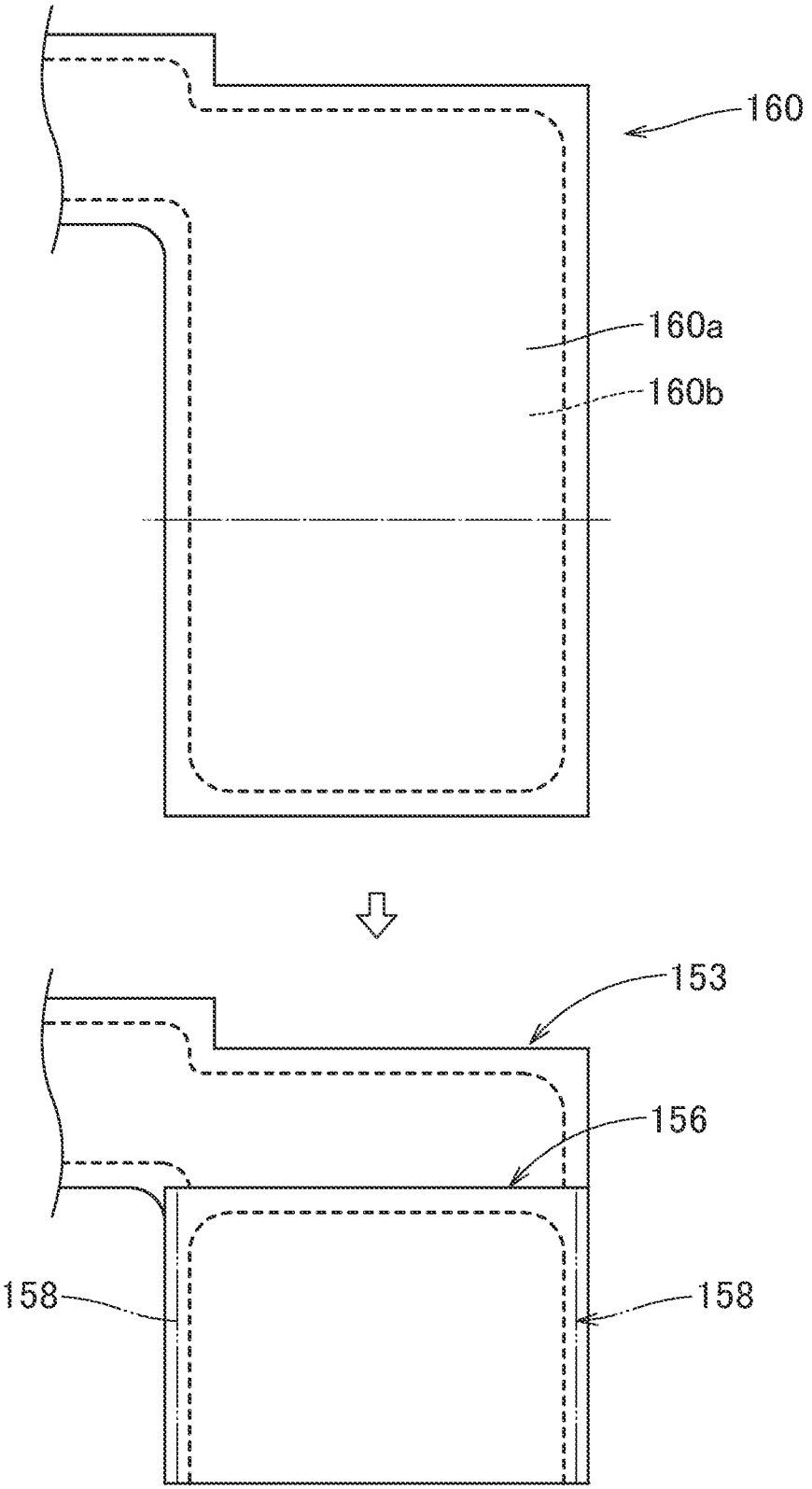
FIG. 34 is a partial enlarged bottom view of an airbag component for forming the airbag of FIG. 33.

In the airbag 150, the protruding inflatable portion 157 is composed of a leading end portion 156*a* of a folded-back portion 156 that has been formed by folding a lower end region of the protecting portion 153 toward the wearer M. To describe more specifically, the protecting portion 153 and protruding inflatable portion 157 are composed of an airbag component 160. The airbag component 160 includes an inner wall 160*a* that is disposed towards the wearer M when worn, and an outer wall 160*b* that is disposed on the outer side when worn, and is formed by being sewn (jointed) together by circumferential edges of the inner wall 160*a* and outer wall 160*b*. The inner wall 160*a* and outer wall 160*b* are substantially identical in outer shape. A lower end region of the airbag component 160 is folded back so the inner wall 160*a* faces one another as shown in FIG. 34, thus the folded-back portion 156 is formed. The airbag component 160 has a uniform width in a left and right direction (in the width direction) from the upper end to the lower end, and has a greater width in an up and down direction than the protecting portion 153 by the length of the folded-back portion 156. In this embodiment, the folded-back portion 156 is sewn (joined) to the front edge and rear edge of the protecting portion 153 by the front edge and rear edge, respectively, by seams 158, thus kept in the folded state. The terminal 156*b* of the folded-back portion 156 is located slightly above the center in the up and down direction of the protecting portion 153 as can be seen in FIG. 33 so as to be disposed at a farther upward position than the trochanter TP when worn, as shown in FIG. 35. In this embodiment, the leading end portion 156*a* of the folded-back portion 156 constitutes the protruding inflatable portion 157 that is configured to cover an outer side (a side) of the trochanter TP amply in the up and down direction at airbag deployment. In this airbag 150, a region of the protecting portion 153 that is disposed farther downward than the protruding inflatable portion 157, namely, a lower region 155, constitutes an extended region that extends farther downwardly than the protruding inflatable portion 157. With a substantially same thickness as the location of the protruding inflatable portion 157, the lower region 155 as inflated is thicker than an upper region 154 of the protecting portion 153 which is disposed farther upward than the protruding inflatable portion 157, as can be seen in FIG. 35.

Since the protecting portion 153 and protruding inflatable portion 157 are formed by folding the lower end region of the airbag component 160 inward, the airbag 150 is far easier to produce compared to the airbag 140 in which the protruding inflatable portion 144 is formed of an inflatable bag separate from the protecting portion 143. In the airbag 150, moreover, the protruding inflatable portion 157 is composed of the leading end portion 156*a* of the folded-back portion 156 that extends upward from the lower edge of the protecting portion 153. In other words, the lower region (or extended region) 155 of the protecting portion 153 which extends farther downwardly than the protruding inflatable portion 157 is configured to be inflated thick amply in the up and down direction. Accordingly, the airbag 150 is also able to protect the subtrochanteric region UP further adequately. The outer cover is omitted also in FIG. 35.

Although the folded-back portion 156 in the airbag 150 is kept in a folded state by being sewn to the protecting portion 153 by the front and rear edges, the means for maintaining the folded state of the folded-back portion should not be limited thereby. By way of example, as indicated with dashed-and-double-dotted lines in FIG. 35, the folded state of the folded-back portion may be maintained by connecting the leading end portion of the folded-back portion with the upper end portion of the protecting portion with a tether 165 or the like. Alternatively, the airbag may be stored inside a not-shown outer cover with the folded-back portion folded so the outer cover keeps the folded state of the folded-back portion.

In the airbags 110, 140, 150 of the second embodiments, the protruding inflatable portion 118, 144, 157 is formed in the entire region in the width direction of the protecting portion 114, 143, 153 (that is, in the entire region in a circumferential direction of the hip MW of the wearer M in the protecting portion 114, 143, 153). The protruding inflatable portion however may be disposed only in a vicinity of the center in the width direction of the protecting portion as long as it is able to cover an outer side of the trochanter.

In the wearable airbag device S2 in accordance with the second embodiment, the airbag 110, 140, 150 includes the two protecting portions 114, 143, 153 that are connected by the gas-feeding path 112, 142, 152 and configured to protect the left and right targeted body parts (i.e. the trochanters TP). However, the structure of the airbag should not be limited thereby. The wearable airbag device may alternatively include two separate airbags each of which is connected with a gas generator for protecting the left/right targeted body part.

With the wearable airbag devices S1 and S2 in accordance with the foregoing embodiments, the two protecting portions 14, 37, 37A, 37B, 47, 52, 114, 143, 153 of the airbags 10, 35, 35A, 35B, 45, 50, 110, 140, 150 are able to protect vicinities of bases of the femurs TB (i.e. the trochanters TP of femurs) of the wearer M in a steady fashion. That is, the wearable airbag devices S1 and S2 in accordance with the foregoing embodiments will help prevent fractures of the femur TB that may take a long time to treat, thus will be suitable for use by elderly people.

The wearable airbag devices S1, S2 of the foregoing embodiments are each designed to have a belt 32 or a wrap portion 124 so as to be wrapped around the pelvis MP. However, the application of the invention should not be limited to the disclosed embodiments. By way of example, the invention may also be applied to a wearable airbag device which is formed into an apparel such as a vest and a jacket for wearing on the torso and includes an airbag for deployment from the lower end portion as worn. Further, although the airbag is stored inside an outer cover in a flatly developed configuration in the foregoing embodiments, the airbag may also be stored inside an outer cover in a folded configuration.

The first embodiment of the present disclosure relates to a wearable airbag device adapted to be worn by a wearer for protecting the hip of the wearer. The airbag device includes an airbag that is formed of a sheet material having flexibility and is adapted to be put on a circumference of the pelvis of the wearer, the airbag being configured to be inflated with an inflation gas. The airbag includes: a mounting portion that is adapted to be disposed at a region to be wrapped around the pelvis at airbag deployment; two protecting portions each of which is configured to extend downward from the mounting portion and cover an outer side of a targeted body part of the wearer at airbag deployment, the targeted body part being left and right trochanters of femurs; and a means for suppressing each of the protecting portions from expanding and floating away from the targeted body part at the lower end at deployment of the protecting portion.

The wearable airbag device in accordance with the first embodiment is configured such that the two protecting portions for covering the targeted body parts (i.e. the trochanters of femurs) extend downward from the mounting portion as put on around the pelvis at airbag deployment. However, the means for suppressing prevents each of the protecting portions from expanding and floating away from the targeted body part at the lower end. Accordingly, each of the protecting portions will be deployed in proximity to the targeted body part (i.e. the trochanter) and cover the outer side of the targeted body part (i.e. the trochanter) quickly and adequately.

Therefore, the wearable airbag device in accordance with the first embodiment is able to protect the hip of the wearer in a steady fashion.

In one or more embodiments, the above airbag may be composed of an airbag component that includes two portions for forming the protecting portions. The airbag component includes: an inner wall that is configured to be disposed towards the wearer when worn, the inner wall including a circumferential edge; and an outer wall that is configured to face away from the wearer when worn, the outer wall being substantially identical in outer shape to the inner wall, the outer wall having a circumferential edge jointed with the circumferential edge of the inner wall. Each of the portions for forming as laid flat includes a foldable portion that extends substantially along an up and down direction in a first edge in a left and right direction of the portion for forming, and a receiving portion that extends substantially along the up and down direction and adjoins the foldable portion. Each of the protecting portions includes, in a first edge thereof in a left and right direction, a double-wall portion in which the foldable portion is folded over the receiving portion and joined to the receiving portion by the upper and lower ends. The double-wall portion constitutes the means for suppressing.

With this configuration, each of the protecting portions will be inflated partially thick due to the double-wall portion composed of the foldable portion and receiving portion, and the foldable portion and receiving portion, each of which is inflated into a board shape, are joined together at the upper ends and lower ends. This configuration will enhance rigidity of each of the protecting portions as inflated and prevent each of the protecting portions as inflated from expanding at the lower end adequately.

In one of more embodiments, the airbag may be configured to include an inner wall that is configured to be disposed towards the wearer when worn, and an outer wall that is configured to face away from the wearer when worn. Each of the protecting portions is configured to cover a body part including regions disposed above and beneath the trochanter. Each of the protecting portions includes, in the outer wall, a protruding region that is configured to protrude partially outwardly at airbag deployment. The protruding region is continuously disposed substantially along an up and down direction as worn, at least in a region for covering an outer side of the region disposed above the trochanter when worn. The protruding region constitutes the means for suppressing.

When the airbag configured as described above is deployed, the protruding region protrudes partially outwardly from the outer wall of each of the protecting portions and functions like a reinforcing rib extending in the up and down direction. The protruding region enhances rigidity of the protecting portion and suppresses the protecting portion as deployed from expanding at the lower end adequately.

In this instance where the protruding region is disposed in the outer wall, the airbag may be configured such that: the outer wall has a greater film length in a front and rear direction as worn than that of the inner wall; and such that the protruding region is composed of a tuck that is formed on the outer wall. This way the protruding region is formed easily.

In one or more embodiments, the airbag may be configured such that: the airbag includes an inner wall that is configured to be disposed towards the wearer when worn, and an outer wall that is configured to face away from the wearer when worn; and such that the inner wall has lower elongation than the outer wall. The inner wall constitutes the means for suppressing. With this airbag, since the outer wall is more prone to elongate than the inner wall at airbag deployment, the airbag will be inflated in such a manner that the outer wall curves more largely than the inner wall. In other words, since the inner wall is suppressed from curving in the up and down direction at airbag deployment, the protecting portion will be suppressed from flaring out and floating away from the targeted body part at the lower end.

In one or more embodiments, the airbag may be configured to include an inner wall that is configured to be disposed towards the wearer when worn, and an outer wall that is configured to face away from the wearer when worn. Each of the protecting portions is configured to cover a body part including regions disposed above and beneath the trochanter. Each of the protecting portions includes, in the inner wall, a joined portion in which two portions in the inner wall spaced apart in a left and right direction are tucked and joined together, the joined portion being continuously disposed substantially along an up and down direction as worn, at least in a region for covering an outer side of the region disposed above the trochanter when worn. The joined portion constitutes the means for suppressing.

With the airbag configured as described above, the joined portion in which a portion extending substantially in the up and down direction of the inner wall is doubled, functions like a reinforcing rib, and enhances the rigidity of a part of the inner wall. Since the location of the joined portion does not stretch easily compared with surroundings in the inner wall or outer wall at airbag deployment, the joined portion suppresses the inner wall from curving largely in the up and down direction when inflated, thus suppresses the protecting portion as deployed from expanding and floating away from the targeted body part at the lower end adequately.

The second embodiment of the disclosure relates to a wearable airbag device adapted to be worn by a wearer for protecting the hip of the wearer. The airbag device includes an airbag that is adapted to be put on a circumference of the pelvis of the wearer, the airbag being configured to be inflated with an inflation gas. The airbag includes: at least one protecting portion that is configured to cover an outer side of a targeted body part of the wearer at airbag deployment, the targeted body part being the left or right trochanter of femur and surroundings, the at least one protecting portion each including an inner surface which faces toward the wearer when worn and an upper end portion; and a protruding inflatable portion that is disposed in the inner surface of each of the at least one protecting portion, the protruding inflatable portion being configured to protrude towards the trochanter at airbag deployment such that a leading end of the protruding inflatable portion is located at a farther inward position than the upper end portion of the protecting portion.

In the wearable airbag device in accordance with the second embodiment, the airbag includes the protruding inflatable portion that is configured to protrude from the inner surface of the at least one protecting portion and be deployed in proximity to the trochanter of femur as the targeted body part at airbag deployment. Accordingly, the protruding inflatable portion is able to cover and protect the trochanter and surroundings quickly and adequately at fall of the wearer.

Therefore, the wearable airbag device in accordance with the second embodiment is able to protect the hip of the wearer in a steady fashion.

In one or more embodiments, each of the at least one protecting portion may include an extended region that extends farther downwardly than the protruding inflatable portion. The airbag with such an extended region is able to protect the subtrochanteric region as well.

In one or more embodiments, in each of the at least one protecting portion, the protruding inflatable portion may be composed of an inflatable bag that is provided separately from the protecting portion and is in gas communication with the protecting portion by at least one communication hole. In this case, the at least one communication hole may be configured to make an inflation gas having flown into the protecting portion flow toward a protruding top of the protruding inflatable portion that is configured to be deployed toward the trochanter. This configuration will help inflate the protruding inflatable portion quickly so the protruding inflatable portion covers the outer side of the trochanter.

In one or more embodiments, each of the at least one protecting portion may include a folded-back portion that is composed of a lower end region of the protecting portion folded back toward the wearer so that the protruding inflatable portion is composed of a leading end portion of the folded-back portion. With this configuration, the protruding inflatable portion will be easier to produce compared with an instance where the protruding inflatable portion is formed of an inflatable bag separate from the protecting portion.

What is claimed is:

1. A wearable airbag device adapted to be worn by a wearer for protecting a hip of the wearer, the airbag device comprising an airbag that is formed of a sheet material having flexibility and is adapted to be put on a circumference of a pelvis of the wearer, the airbag being configured to be inflated with an inflation gas, wherein the airbag includes:

a mounting portion that is adapted to be disposed at a region to be wrapped around the pelvis at airbag deployment;

two protecting portions each of which is configured to extend downward from the mounting portion and cover an outer side of a targeted body part of the wearer at airbag deployment, the targeted body part being left and right trochanters of femurs; and a means for suppressing each of the protecting portions from expanding and floating away from the targeted body part at a lower end at deployment of each of the protecting portions, wherein the airbag is composed of an airbag component that includes two portions for forming the protecting portions;

the airbag component includes: an inner wall that is configured to be disposed towards the wearer when worn, the inner wall including a circumferential edge; and an outer wall that is configured to face away from the wearer when worn, the outer wall being substantially identical in outer shape to the inner wall, the outer wall having a circumferential edge jointed with the circumferential edge of the inner wall;

each of the portions for forming as laid flat includes a foldable portion that extends substantially along an up and down direction in a first edge in a left and right direction of the portion for forming, and a receiving portion that extends substantially along the up and down direction and adjoins the foldable portion;

each of the protecting portions includes, in a first edge thereof in a left and right direction, a double-wall portion in which the foldable portion is folded over the receiving portion and joined to the receiving portion by upper and lower ends thereof; and the double-wall portion constitutes the means for suppressing.

2. The wearable airbag device of claim 1, wherein:

the airbag includes the inner wall that is configured to be disposed towards the wearer when worn, and the outer wall that is configured to face away from the wearer when worn;

each of the protecting portions is configured to cover a body part including regions disposed above and beneath the trochanter;

each of the protecting portions includes, in the outer wall, a protruding region that is configured to protrude partially outwardly at airbag deployment, the protruding region being continuously disposed substantially along the up and down direction as worn, at least in a region for covering an outer side of the region disposed above the trochanter when worn; and the protruding region constitutes the means for suppressing.

3. The wearable airbag device of claim 2, wherein:

the outer wall has a greater film length in a front and rear direction as worn than that of the inner wall; and the protruding region is composed of a tuck that is formed on the outer wall.

4. The wearable airbag device of claim 1, wherein:

the airbag includes the inner wall that is configured to be disposed towards the wearer when worn, and the outer wall that is configured to face away from the wearer when worn; and the inner wall has lower elongation than the outer wall, and the inner wall constitutes the means for suppressing.

5. The wearable airbag device of claim 1, wherein:

the airbag includes the inner wall that is configured to be disposed towards the wearer when worn, and the outer wall that is configured to face away from the wearer when worn;

each of the protecting portions is configured to cover a body part including regions disposed above and beneath the trochanter;

each of the protecting portions includes, in the inner wall, a joined portion in which two portions in the inner wall spaced apart in the left and right direction are tucked and joined together, the joined portion being continuously disposed substantially along the up and down direction as worn, at least in a region for covering an outer side of the region disposed above the trochanter when worn; and the joined portion constitutes the means for suppressing.

6. The wearable airbag device of claim 1, further including an outer cover that covers an outer circumference of the airbag, the outer cover being adapted to be wrapped around the hip of the wearer.

* * * * *